US008941446B2

(12) United States Patent
Kroening

(10) Patent No.: US 8,941,446 B2
(45) Date of Patent: Jan. 27, 2015

(54) FERRITE CIRCULATOR WITH INTEGRATED E-PLANE TRANSITION

(71) Applicant: Honeywell International Inc., Morristown, NJ (US)

(72) Inventor: Adam M. Kroening, Atlanta, GA (US)

(73) Assignee: Honeywell International Inc., Morristown, NJ (US)

( * ) Notice: Subject to any disclaimer, the term of this patent is extended or adjusted under 35 U.S.C. 154(b) by 53 days.

(21) Appl. No.: 13/894,519

(22) Filed: May 15, 2013

(65) Prior Publication Data

US 2014/0340165 A1 Nov. 20, 2014

(51) Int. Cl.

| | |
|---|---|
| ***H01P 1/39*** | (2006.01) |
| ***H01P 1/38*** | (2006.01) |
| ***H01P 11/00*** | (2006.01) |

(52) U.S. Cl.

CPC ..... *H01P 1/38* (2013.01); *H01P 11/001* (2013.01); *H01P 1/39* (2013.01)

USPC ..... 333/1.1

(58) Field of Classification Search

CPC ..... H01P 1/38; H01P 1/39; H01P 1/32

USPC ..... 333/1.1, 24.2

See application file for complete search history.

(56) References Cited

U.S. PATENT DOCUMENTS

| | | | | |
|---|---|---|---|---|
| 3,105,206 | A * | 9/1963 | Bosset et al. | 333/1.1 |
| 3,833,868 | A * | 9/1974 | Booth | 333/157 |
| 6,407,646 | B1 | 6/2002 | Johnson | |
| 6,885,257 | B2 | 4/2005 | Kroening | |
| 7,049,900 | B2 | 5/2006 | Kroening | |
| 7,176,767 | B2 | 2/2007 | Kroening | |
| 7,230,507 | B2 | 6/2007 | Kroening | |
| 7,242,263 | B2 | 7/2007 | Kroening | |
| 7,561,003 | B2 | 7/2009 | Kroening | |
| 2006/0232353 | A1 | 10/2006 | Kroeing | |
| 2007/0139131 | A1 | 6/2007 | Kroening | |

(Continued)

FOREIGN PATENT DOCUMENTS

WO 2007068261 6/2007

OTHER PUBLICATIONS

Gherm et al., "An Investigation of Six-Point Phase-Type Circulators and Switches", May 1969, pp. 1-8.

(Continued)

*Primary Examiner* — Stephen Jones
(74) *Attorney, Agent, or Firm* — Fogg & Powers LLC

(57) ABSTRACT

A waveguide circulator system for an E-plane-layer transition includes a first waveguide including: at least N waveguide arms, and a first-interface aperture spanning a first X-Y plane on a bottom surface of a first waveguide arm, a ferrite element having N segments protruding into the N respective waveguide arms of the first waveguide; an E-plane-transition waveguide having a first open-end and a second opposing open-end; and a second waveguide including a second-interface aperture spanning a second X-Y. The first-interface aperture is arranged to proximally overlap the first open-end. The second second-interface aperture of the second waveguide and the second-interface aperture is arranged to proximally overlap the second open-end. At least a portion of the first segment of the ferrite element protrudes into a volume extending between the first-interface aperture on the bottom surface of the first waveguide arm and an opposing top surface of the first waveguide arm.

20 Claims, 33 Drawing Sheets

(56) References Cited

U.S. PATENT DOCUMENTS

| | | | |
|---|---|---|---|
| 2010/0066460 | A1 | 3/2010 | Hocine et al. |
| 2012/0081189 | A1 | 4/2012 | Nealis et al. |

OTHER PUBLICATIONS

Kim et al., "The New Approach to Designing W-Band Y-Junction Circulator with Small Insertion Loss", "1998 IEEE MTT-S Digest", Jun. 1998, pp. 637-639.

European Patent Office, "European Search Report from EP Application No. 14166281.7 mailed Oct. 2, 2014", "from Foreign Counterpart of U.S. Appl. No. 13/894,519", Oct. 2, 2014, pp. 13, Published in: EP.

European Patent Office, "Office Action from EP Application No. 14166281.7 mailed Oct. 17, 2014", "from Foreign Counterpart of U.S. Appl. No. 13/894,519", Oct. 17, 2014, pp. 13, Published in: EP.

* cited by examiner

FERRITE CIRCULATOR WITH INTEGRATED E-PLANE TRANSITION

BACKGROUND

Waveguide circulators with E-plane transitions have a wide variety of uses in commercial, military, space, terrestrial, low power applications, and high power applications. Such waveguide circulators are important in space applications (for example, in satellites) where reliability is essential and where reducing size and weight is important. Moving parts wear down over time and have a negative impact on long term reliability. Waveguide circulators made from a ferrite material have high reliability due to their lack of moving parts. Thus, the highly reliable ferrite circulators are desirable for space applications.

Rectangular waveguide E-plane layer transitions are often utilized in complex switch matrices. Such complex switch matrices with layer transitions are used on commercial, military, and space products including switched beam antennas, order-constrained beam switching networks, and low noise amplifier (LNA) redundancy switch assemblies.

Order-constrained switch networks require a large number of crossovers between independent paths, and thus require a large number of E-plane layer transitions to implement the path crossovers. The advantages of order-constrained switch networks are discussed in "Technical Report 639—Design of Microwave Beam-Switching Networks," M. L. Burrows, 5 Dec. 1983, Lincoln Laboratory. Since order-constrained switch networks require a large number of E-plane transitions, and the current technology for E-plane transitions requires a spacing of one-quarter to one-wavelength between the E-plane transition and the ferrite switches, the order-constrained switch networks may become large in size and high in loss.

SUMMARY

The present application relates to a waveguide circulator system for an E-plane-layer transition of an electro-magnetic field having a wavelength. The waveguide circulator includes a first waveguide including: at least N waveguide arms, where N is a positive integer, and a first-interface aperture spanning a first X-Y plane on a bottom surface of a first waveguide arm of the first waveguide. The waveguide circulator also includes a ferrite element having N segments protruding into the N respective waveguide arms of the first waveguide, the N segments including a first segment protrude into a first waveguide arm of the first waveguide. The waveguide circulator also includes an E-plane-transition waveguide having a first open-end and a second opposing open-end defined by side-walls having a length; and a second waveguide including a second-interface aperture spanning a second X-Y plane on a top surface of the second waveguide, the first X-Y plane offset from the second X-Y plane along a Z axis by the length of the E-plane-transition waveguide. The first open-end of the E-plane-transition waveguide is approximately a same shape as the first-interface aperture of the first waveguide and the first-interface aperture is arranged to proximally overlap the first open-end. The second open-end of the E-plane-transition waveguide is approximately a same shape as the second second-interface aperture of the second waveguide and the second-interface aperture is arranged to proximally overlap the second open-end. At least a portion of the first segment of the ferrite element protrudes into a volume extending between the first-interface aperture on the bottom surface of the first waveguide arm and an opposing top surface of the first waveguide arm.

DRAWINGS

In accordance with common practice, the various described features are not drawn to scale but are drawn to emphasize features relevant to the present invention. Like reference characters denote like elements throughout figures and text.

DETAILED DESCRIPTION

Figure 1A:
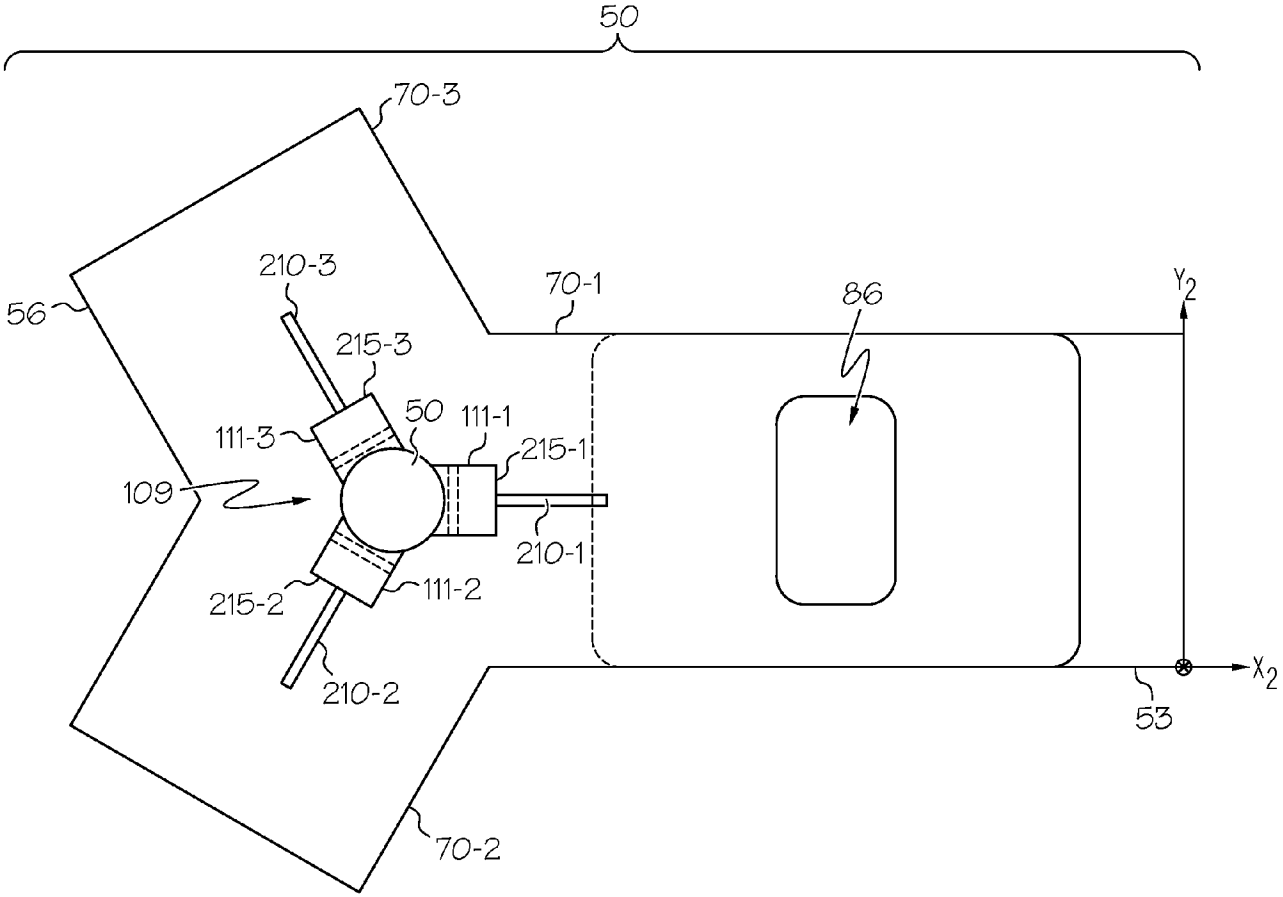
FIG. 1A (PRIOR ART)
FIGS. 1A-1C are block diagrams illustrating top, oblique, and side views, respectively, of a currently available waveguide circulator system.

In the following detailed description, reference is made to the accompanying drawings that form a part hereof, and in which is shown by way of illustration specific illustrative embodiments in which the invention may be practiced. These embodiments are described in sufficient detail to enable those skilled in the art to practice the invention, and it is to be understood that other embodiments may be utilized and that logical, mechanical and electrical changes may be made without departing from the scope of the present invention. The following detailed description is, therefore, not to be taken in a limiting sense.

It is desirable to reduce the size of waveguide circulator systems with E-plane transitions in order to reduce the cost, weight, size, and insertion loss (ohmic loss) of a single ferrite fixed-bias circulator and in order to reduce the cost, weight, size, and loss of a switching circulator network that includes more than one ferrite element. The present application describes embodiments of ferrite waveguide circulator systems, including integrated E-plane transitions, that each reduces the cost, weight, size, and loss of the waveguide circulator system.

In the embodiments described in this document, the E-plane layer transitions are integrated into the ferrite switch regions by incorporating the E-plane transition as part of the transition from the resonant section of the ferrite element to the empty waveguide. Specifically, the length of at least one waveguide arm is designed to permit a ferrite element segment and/or a section of the quarter-wave dielectric transformer to be integrated with (to overlap) the region of the E-field T-junction. In these embodiments, the waveguides are designed to remove the prior art spacing of one-quarter-wavelength (λ/4) to one-wavelength (λ) between the E-field T-junction and the ferrite segment (or the quarter-wave dielectric transformer) as shown in the prior art system of FIG. 1A-1C (or 5A-5C).

Embodiments of the reduced-size waveguide circulator systems described in this document include an E-plane transition from a waveguide ferrite circulator on one layer (a circulator layer) to an empty waveguide on another layer, using an E-plane transition that overlaps of at least one of: 1) at least a portion of a quarter-wave dielectric transformer; or 2) at least a portion of a ferrite element segment. The circulator layer includes a backshort to integrate the E-plane transition with the ferrite circulator. In this manner, the E-plane transition becomes part of the transition from the resonant section of the ferrite element to the empty waveguide on the other layer via an E-plane transition waveguide.

Embodiments of the reduced-size waveguide circulator systems described in this document also include an E-plane transition from a first ferrite circulator on a first circulator layer to a second ferrite circulator on a second circulator layer, which is offset from the first circulator layer by the length of an E-plane transition waveguide. The first circulator layer and second circulator layer include respective backshorts to integrate the E-plane transition with the respective first ferrite circulator and second ferrite circulator. These latter embodiments use an E-plane transition that overlaps of at least one of: 1) at least a portion of a quarter-wave dielectric transformer in the first circulator; 2) at least a distal portion of a ferrite element segment in the first circulator; 3) at least a portion of a quarter-wave dielectric transformer in the second circulator; and 4) at least a distal portion of a ferrite element segment in the second circulator. In this manner, the E-plane transition in the first circulator layer and second circulator layer becomes part of the transition from and to, respectively, the resonant section of the first and second ferrite elements, respectively, via an E-plane transition waveguide.

All of these non-prior art embodiments improve upon the currently available waveguide circulator systems by eliminating the ohmic loss associated with the empty waveguide transition between a ferrite switching circulator and an E-plane waveguide transition. Additionally, all of these non-prior art embodiments reduce the size and weight of the waveguide circulator system.

Acceptable coupling performance is achieved with the simple transition geometry shown in the drawings of FIGS. 2A-4C and 6A-10C. In some embodiments, the performance is additionally optimized with additional tuning features in the E-plane transition region. Such tuning features include, but are not limited to, capacitive tuning buttons, slight non-uniformities in the shape or size of the waveguide, slight non-uniformities in the shape or size the backshort, and/or slight non-uniformities in the shape or size the apertures that interconnect the two waveguide layers.

These new transitions therefore provide the advantages of reduced loss, size, and mass through a shorter transition path length. In its most basic form, this concept could be implemented on a single ferrite fixed-bias circulator or switching circulator. However, it is most useful in complex switching networks that require a large number of transitions between switch layers either for size savings or due to crossovers between paths in the network.

The design process comprises the following software modeling step: 1) design a standalone ferrite circulator using standard methods; and 2) re-optimize the return loss of the circulator after the addition of an E-plane transition. The optimizing design processes include, but are not limited to: adjusting the size of the iris/aperture between the two layers; adjusting the length of the two back-shorts associated with the iris/aperture; adjusting the shape of the ferrite element; and adjusting the quarter-wave transformer dimensions.

Before describing the embodiments of FIGS. 2A-4C, a prior art system is described in order to emphasize the improved length available from the embodiments of FIGS. 2A-4C.

Figure 1B:
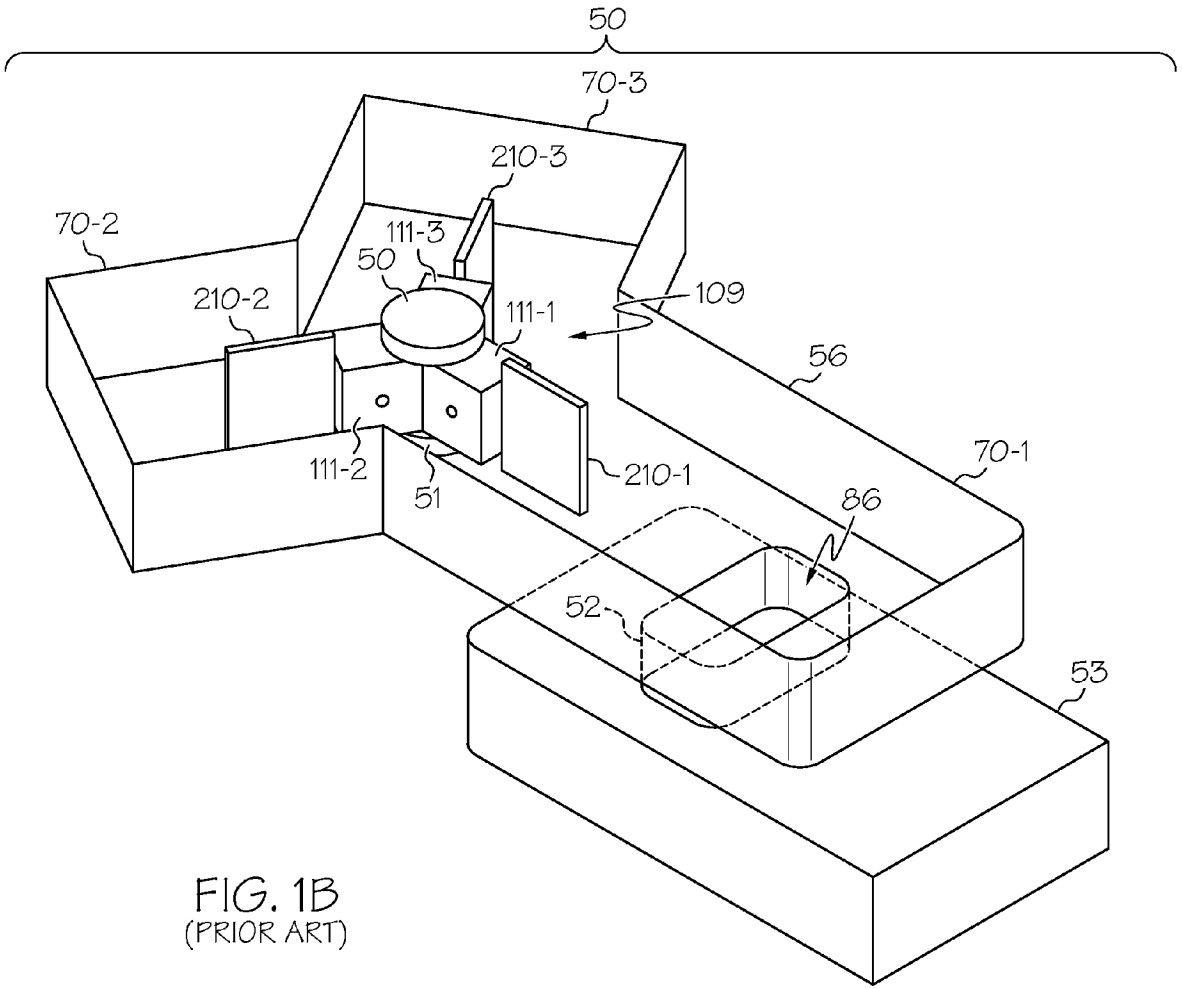
FIG. 1B (PRIOR ART)
Figure 1C:
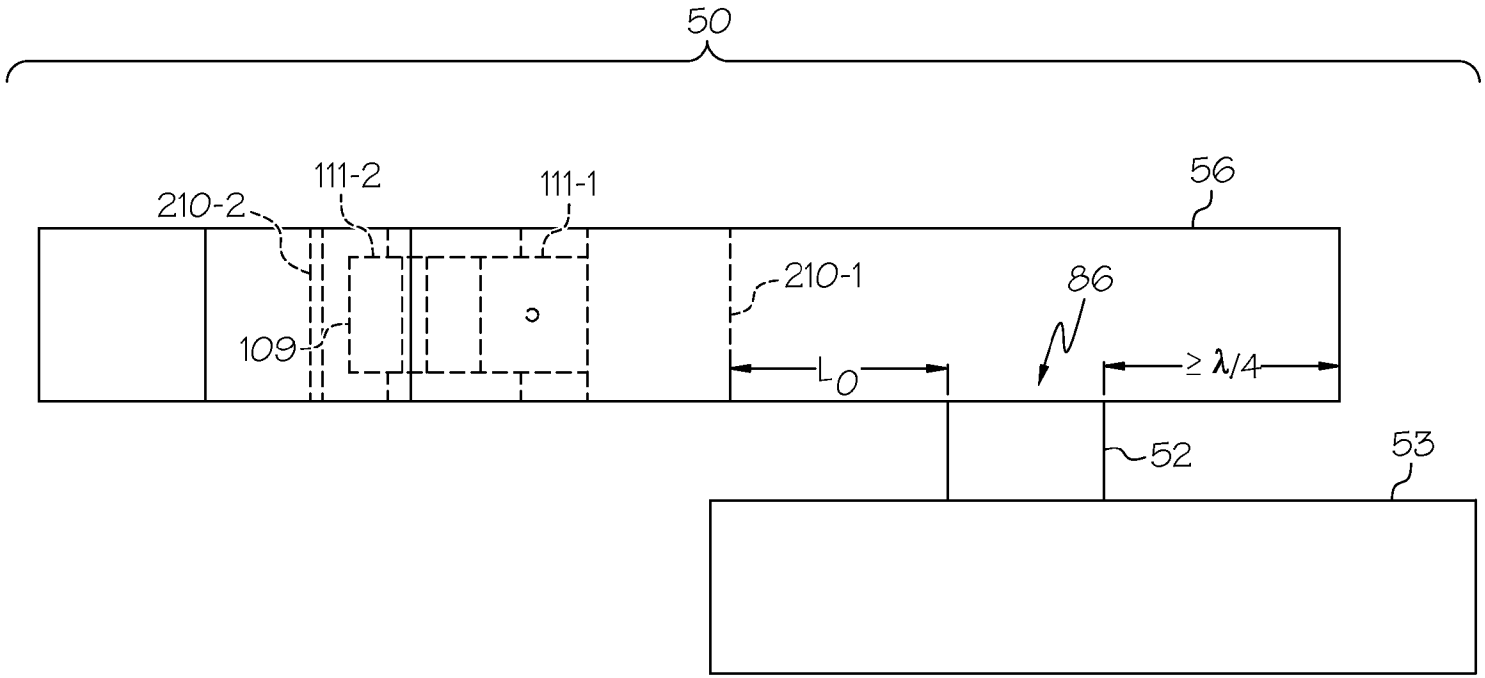
FIG. 1C (PRIOR ART)

FIGS. 1A-1C are block diagrams illustrating top, oblique, and side views, respectively, of a currently available waveguide circulator system 50. The currently available waveguide circulator system 50 includes a first waveguide 56 including three waveguide arms 70(1-3), a ferrite element 109 having 3 segments 111(1-3) protruding into the three respective waveguide arms 70(1-3) of the first waveguide 56, an E-plane-transition waveguide 52, and a second waveguide 53. Three quarter-wave dielectric transformers 210(1-3) are attached to respective ends 215(1-3) of the three segments 111(1-3) of the ferrite element 109. The aperture 86 of the E-plane-transition waveguide 52 is offset from the end of the quarter-wave dielectric transformer 210-1 by more than a quarter-wavelength (λ/4) of the electro-magnetic radiation propagating in the waveguide circulator system 50. This distance is shown in FIG. 1C as $L_0$. Typically, $L_0$ is between (λ/4) and λ, where λ is the wavelength of the electro-magnetic radiation propagating in the waveguide circulator system 50. The electric-field component of the electro-magnetic radiation oscillates in the E-plane, which is perpendicular to the broad wall (in the $X_1$-$Y_1$ plane). If the currently available waveguide circulator system 50 includes any backshort, that backshort is about a quarter-wavelength (λ/4) from the aperture to the E-plane-transition waveguide 52 and at least λ/2 from the end (distal from the ferrite element 109) of the quarter-wave dielectric transformer 210-1.

Figure 2A:
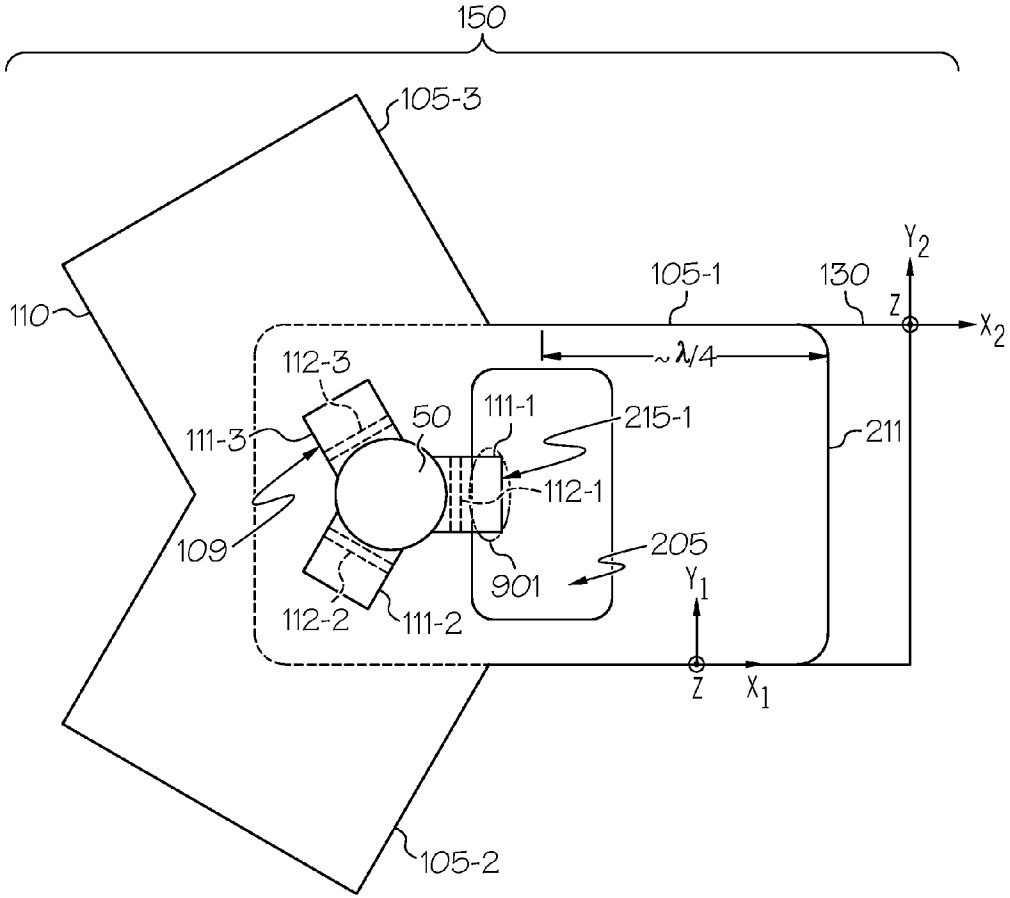
FIGS. 2A-2C are block diagrams illustrating top, oblique, and side views, respectively, of a waveguide circulator system in accordance with one embodiment.
Figure 2B:
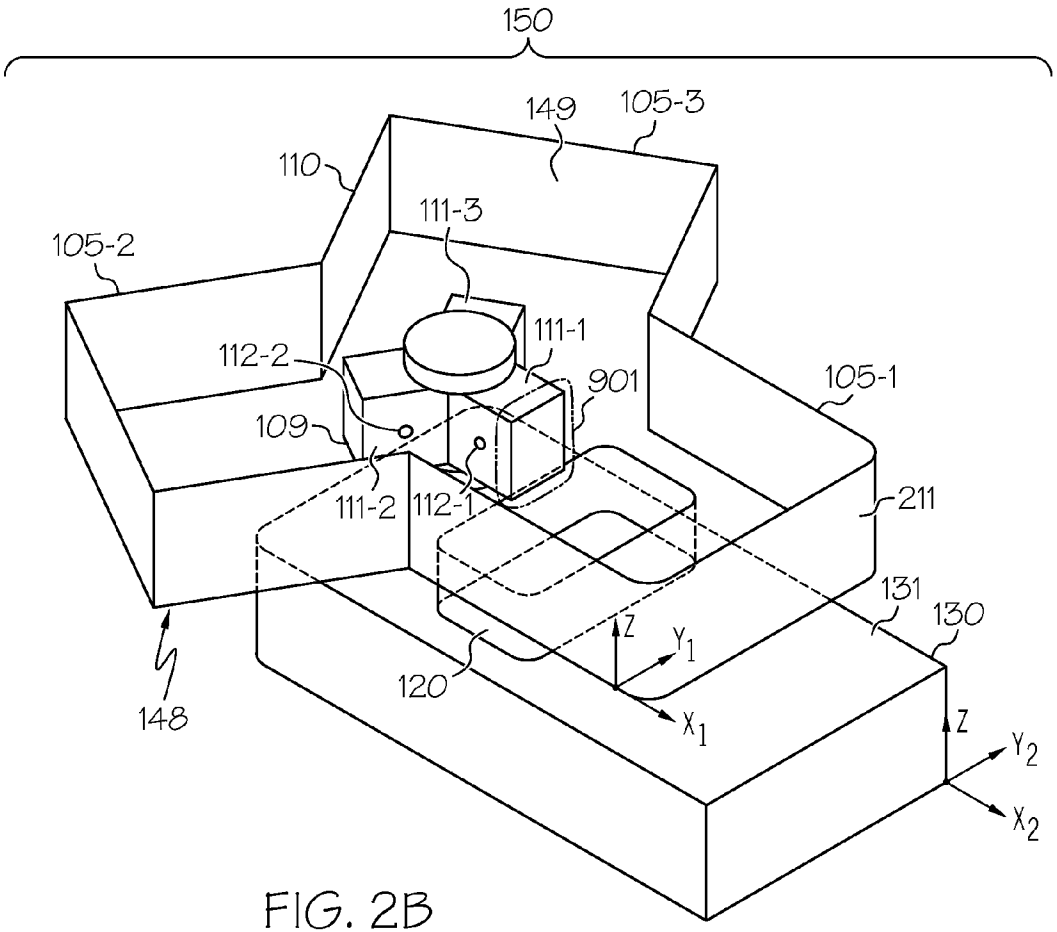
Figure 2C:
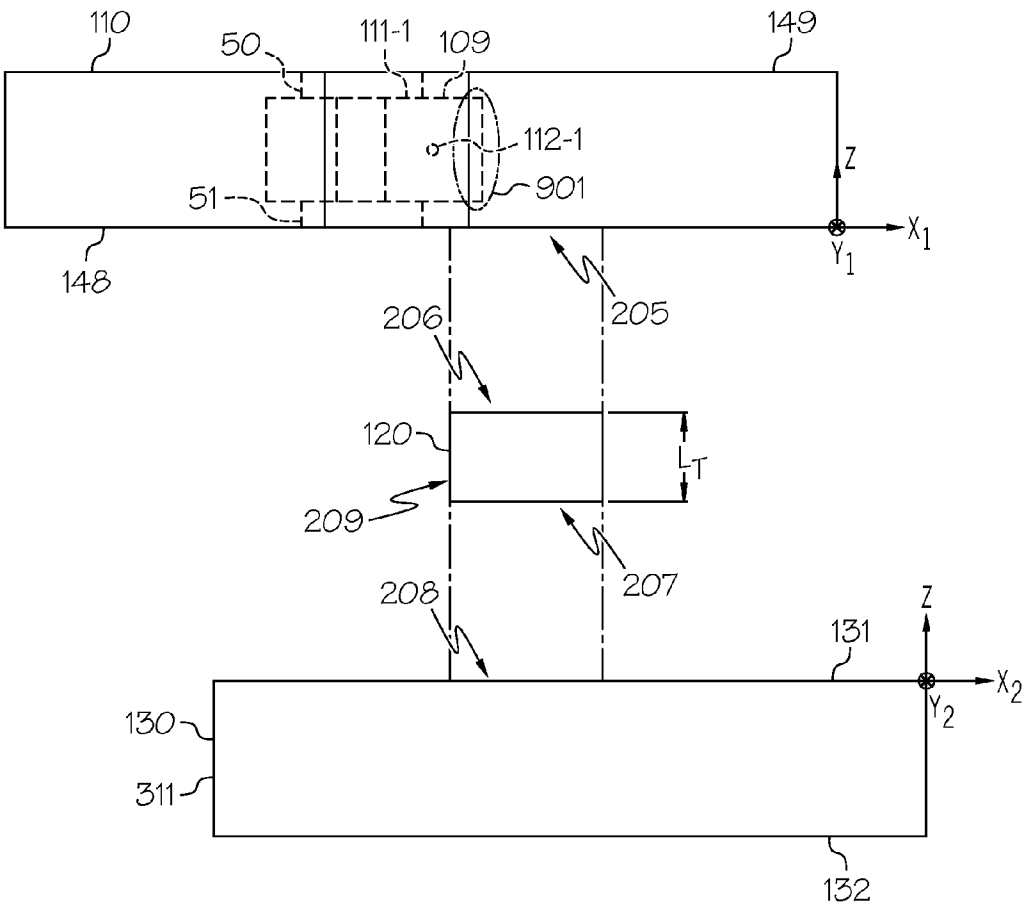

FIGS. 2A-2C are block diagrams illustrating top, oblique, and side views, respectively, of a waveguide circulator system 150 in accordance with one embodiment. The waveguide circulator system 150 for an E-plane-layer transition of an electro-magnetic field having a wavelength λ, includes a first waveguide 110, a ferrite element 109, an E-plane-transition waveguide 120, and a second waveguide 130. The first waveguide 110 is on the circulator layer. The second waveguide 130 is on another layer. The elements of FIG. 2C are shown in a side view, in which the first waveguide 110, the E-plane-transition waveguide 120, and the second waveguide 130 are separated along the z direction in order to clearly indicate the apertures 205-208.

The first waveguide 110 is conductive and includes at least N waveguide arms 105(1-N), where N is a positive integer. As shown in the drawings N equals 3 but other values for N are possible. The waveguide arms 105(1-3) include a first waveguide arm 105-1, a first-other waveguide arm 105-2, and a second-other waveguide arm 105-3. A first-interface aperture 205 (FIGS. 2A and 2C) spans a first $X_1$-$Y_1$ plane on a bottom surface 148 of the first waveguide arm 105-1 of the first waveguide 110. A backshort 211 (e.g., a waveguide wall 211) spans a $Y_1$-Z plane at an end of the first waveguide arm 105-1. The backshort 211 is positioned about a quarter of the wavelength (λ/4) from the first-interface aperture 205.

The ferrite element 109 (also referred to herein as a ferrite circulator 109) has N segments 111(1-N) protruding into the N respective waveguide arms 105(1-N) of the first waveguide 110. The three segments 111(1-3) include a first segment 111-1 protruding into the first waveguide arm 105-1 of the first waveguide 110. The three segments 111(1-3) also include a first-other segment 111-2 that protrudes into the first-other waveguide arm 105-2, and a second-other segment 111-3 that protrudes into the second-other waveguide arm 105-3. The length of the first-waveguide arm 105-1 is optimized to maximize the transfer of energy from the first segment 111-1 to the E-plane-transition waveguide 120. In one implementation of this embodiment, the backshort 211 is about λ/4 from the end 215-1 of the first segment 111-1.

The E-plane-transition waveguide 120 has a first open-end 206 (FIG. 2C) and a second opposing open-end 207 defined by side-walls 209 having a length $L_T$(FIG. 2C). In one implementation of this embodiment, the length $L_T$ of the side-walls 209 is less than a quarter of the wavelength (λ/4).

The second waveguide 130 includes a second-interface aperture 208 (FIG. 2C) spanning a second $X_2$-$Y_2$ plane on a top surface 131 of the second waveguide 130. The second waveguide 130 includes a bottom surface 132 opposing the top surface 131. The first $X_1$-$Y_1$ plane is offset from the second $X_2$-$Y_2$ plane along a Z axis (Z) by the length $L_T$ of the E-plane-transition waveguide 120. The second waveguide 130 includes a backshort 311 in the $Y_2$-Z plane. The backshort 311 spans a $Y_2$-Z plane at an end of the second waveguide arm. The backshort is positioned about a quarter of the wavelength (λ/4) from the second-interface aperture 208.

The first open-end 206 of the E-plane-transition waveguide 120 is approximately a same shape as the first-interface aperture 205 of the first waveguide 110. The shape as the first-interface aperture 205 can be rectangular, elliptical, rectangular with rounded corners, or a shape that includes at least four straight lines. The first-interface aperture 205 is arranged to proximally overlap the first open-end 206. The second open-end 207 of the E-plane-transition waveguide 120 is approximately the same shape as the second second-interface aperture 208 of the second waveguide 130. The second-interface aperture 208 is arranged to proximally overlap the second open-end 207.

At least a portion 901 (FIGS. 2A and 2C) of the first segment 111-1 of the ferrite element 109 protrudes into a volume that extends between the first-interface aperture 205 on the bottom surface 148 of the first waveguide arm 105-1 and an opposing top surface 149 of the first waveguide arm 105-1. This volume is also referred to herein as a "transition region." Thus, the first waveguide 110 is shorter in the $X_1$ direction than the prior art first waveguide 56 (FIGS. 1A-1C) in the $X_1$ direction. The protrusion of portion 901 into transition region integrates the ferrite circulator 109 with the E-plane transition in the transition region. Therefore, the size, mass, and insertion loss (ohmic loss) of the waveguide circulator system 150 is less than that of the prior art waveguide system 50. In the direction of propagation of the electro-magnetic radiation, the impedance matching chain from the ferrite element 109 is reduced. In one implementation of this embodiment, the wavelength of the electro-magnetic radiation propagating in the waveguide circulator system 150 is in the range of radio frequency (RF) wavelengths. In another implementation of this embodiment, the wavelength of the electro-magnetic radiation propagating in the waveguide circulator system 150 is in the range of microwave frequency wavelengths.

In at least one implementation, ferrite element 109 is a switchable or latchable ferrite circulator as opposed to a fixed bias ferrite circulator. A latchable ferrite circulator is a circulator where the direction of circulation can be latched in a certain direction. To make ferrite element 109 switchable, a magnetizing winding (not shown) is threaded through apertures 112(1-3) in the segments 111(1-3), respectively, of ferrite element 109 that protrude into the separate waveguide arms 105(1-3). Currents passed through a magnetizing winding control and establish a magnetic field in ferrite element 109. The polarity of magnetic field can be switched by the application of current on magnetizing winding to create a switchable circulator. The portion of ferrite element 109 where the segments 111 of the ferrite element 109 converge is referred to as a resonant section of ferrite element 109. The dimensions of the resonant section determine the operating frequency for circulation in accordance with conventional design and theory. The three protruding segments 111(1-3) of ferrite element 109, that are distal to the resonant section beyond the apertures 112(1-3) act both as return paths for the bias fields in resonant section and as impedance transformers out of resonant section. The return-path section of the segment 111-1 is the section of the segment 111-1 that protrudes (at least in part) into the transition region. The resonant section of ferrite element 109 does not protrude into the transition region between the bottom surface 148 and top surface 149 of the first waveguide arm 105-1.

In further embodiments, a dielectric spacer 50 is disposed on a surface of ferrite element 109 that is parallel to the H-plane. The magnetic-field component of the electro-magnetic radiation oscillates in the H-plane, which is parallel to the broadwall (in the $X_1$-$Y_1$ plane). The dielectric spacer 50 is used to securely position ferrite element 109 in the first waveguide 110 and to provide a thermal path out of ferrite element 109 for high power applications. In some embodiments, a second dielectric spacer 51 (FIG. 2) is located on a surface of the ferrite element 109 that is opposite to the surface of ferrite element 109 in contact with dielectric spacer 50. The components described above are disposed within conductive first waveguide 110.

Magnetic fields created in ferrite element 109 can be used to change the direction of propagation of an electro-magnetic field (e.g., a microwave signal or an RF signal). The electro-magnetic field can change from propagating in one waveguide arm 105 to propagating in another-waveguide arm 105. A reversing of the direction of the magnetic field reverses the direction of circulation within ferrite element 109. The reversing of the direction of circulation within ferrite element 109 also switches which waveguide arm 105 propagates the signal away from ferrite element 109.

In at least one exemplary embodiment, the waveguide-arm 105-1 functions as an output arm and one of the two other waveguide arms 105-2 or 105-3 function as an input arm. The output waveguide arm 105-1 propagates the electro-magnetic field into the E-plane-transition waveguide 120. A microwave signal or an RF signal received from an input waveguide arm 105-2 or 105-3 can be routed with a low insertion loss from the one waveguide arm 105-2 or 105-3 to the output waveguide arm 105-1.

When the magnetic fields in the ferrite element 109 are changed, the waveguide-arm 105-1 functions as an input arm and one of the two other waveguide arms 105-2 or 105-3 function as an output arm. In this case, the input waveguide arm 105-1 propagates the electro-magnetic field from the E-plane-transition waveguide 120 to one of the other waveguide arms 105-2 or 105-3. Thus, the ferrite element 109 has a selectable direction of circulation. As shown, the ferrite element 109 is a Y-shaped ferrite element 109. Other shapes are possible.

Figure 2D:
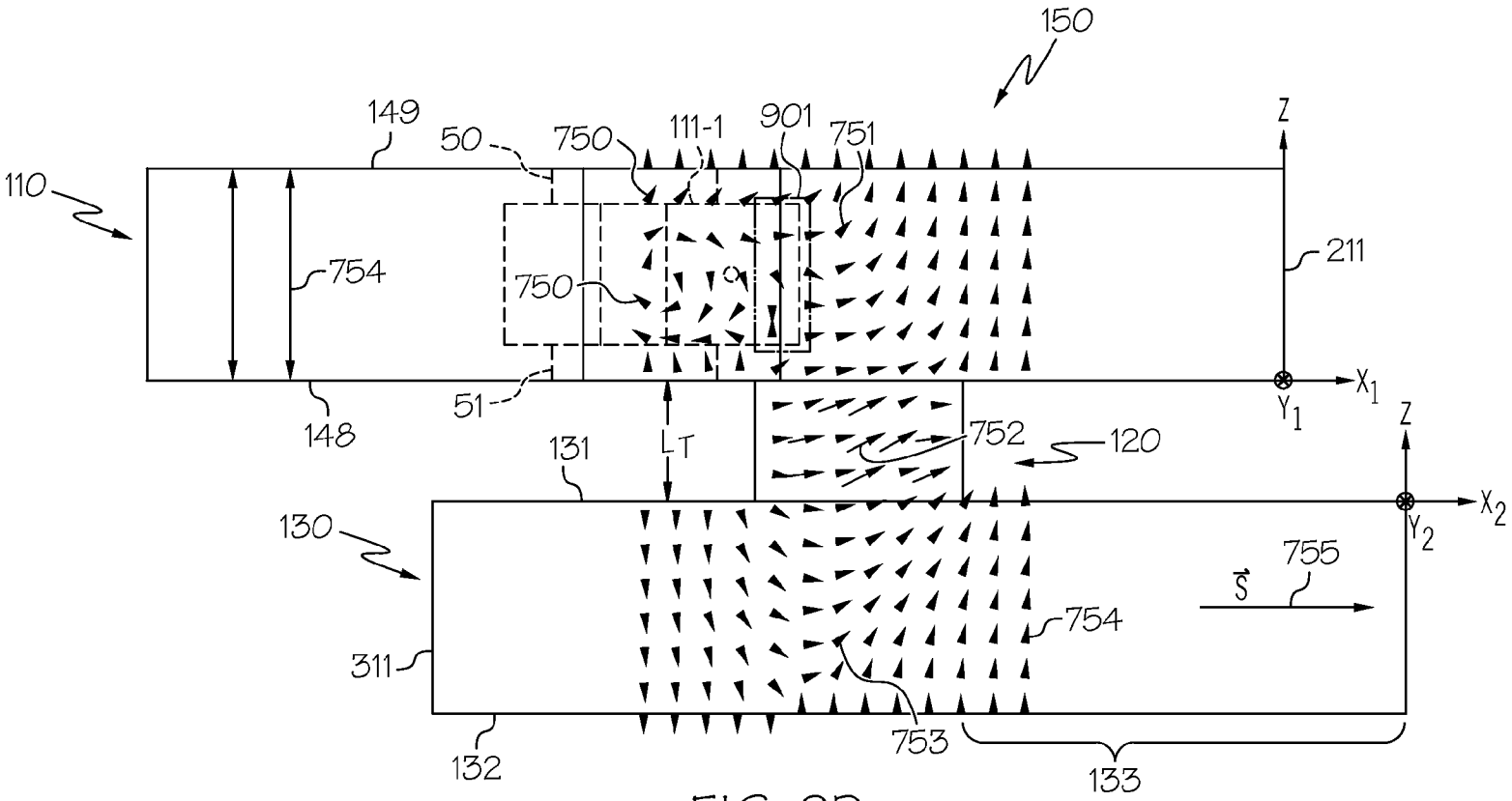
FIG. 2D shows the propagation of the E-field in the waveguide circulator system of FIGS. 2A-2C.

FIG. 2D shows the propagation of the E-field in the waveguide circulator system 150 of FIGS. 2A-2C. The E-field vector 754 in the first waveguide 110, which is in one of the waveguide arms 105-2 or 105-3 prior to being incident on the ferrite element 109, is normal to the broad wall in the $X_1$-$Y_1$ plane in the first waveguide 110. The terms "E-field vector" and "E-field" are used interchangeably herein. As the electro-magnetic radiation propagates through the ferrite element 109, the E-field vectors represented generally at 750 are not completely normal to the broad wall in the $X_1$-$Y_1$ plane of the first waveguide 110. After the electro-magnetic radiation is radiated from the first segment 111-1 of the ferrite element 109, the E-field vectors represented generally at 751 are not settled out to being normal to the broad wall in the $X_1$-$Y_1$ plane. The E-field vectors 751 in the transition region (e.g., in the volume that extends between the first-interface aperture 205 on the bottom surface 148 of the first waveguide arm 105-1 and an opposing top surface 149 of the first waveguide arm 105-1) are not all normal to the bottom surface 148 or the top surface 149.

It is because of this non-normal E-field 751 that the prior art waveguide circulator system 50 included the length (typically, greater than ¼ wavelength) required for the E-field to return to the normal waveguide TE10 mode of propagation before introducing the aperture of the E-plane-transition waveguide 52 (FIGS. 1B and 1C). Specifically, after any disturbance such as a circulator, transformer, waveguide bend, etc., prior to the introduction of this technology, it has been common practice to allow the E-field 750 and 751 to return to the normal waveguide TE10 mode of propagation.

However, as shown in FIG. 2D, when the E-field 750 propagates from the segment 111-1 of the ferrite element 109, the addition of the first-interface aperture 205 and the E-plane-transition waveguide 120 at the lower region (e.g., the bottom surface 148) of the transition region causes the E-field vectors 751 to rotate toward an alignment parallel to the $X_1$-$Y_1$ plane. The E-field 751 is directed into the E-plane-transition waveguide 120 via the interface between the proximally overlapping first-interface aperture 205 and first open-end 206. This interface is also referenced herein as an E-plane T-junction. Some of the E-field 751 propagates close to the bottom surface 148 of the first waveguide arm 105-1 and bends into the plane-transition waveguide 120 via the first-interface aperture 205, while some of the E-field 751 propagates close to the top surface 149 of the first waveguide arm 105-1 and continues propagating on in the first waveguide arm 105-1. The addition of the backshort 211 approximately a quarter wavelength (λ/4) from the center of the first-interface aperture 205 creates a standing wave that optimizes the power transfer into the first-interface aperture 205 and minimizes the reflected power transfer back into the ferrite element 109.

The E-field vectors represented generally at 752 within the E-plane-transition waveguide 120 are approximately normal to the broad wall in the Y-Z plane of the E-plane-transition waveguide 120. Inside the E-plane-transition waveguide 120, the E-field vectors 752 are directed into the second waveguide via the interface between the proximally overlapping second open-end 207 and second-interface aperture 208. The length $L_T$ of the E-plane-transition waveguide 120 is based on the impedance mismatch at the T junction, which starts at the interface between the proximally overlapping first-interface aperture 205 and first open-end 206. The E-plane-transition waveguide 120 experiences a mismatch at both the first open-end 206 and the second open-end 207. The distance to the backshorts 211 and 311 in first waveguide 110 and second waveguide 130, respectively, and the length $L_T$ of the E-plane-transition waveguide 120, are designed to match the impedance into and out of the E-plane-transition waveguide 120 to ensure maximum power transfer from the ferrite element 109 to the second waveguide 130.

In the second waveguide 130, the E-fields represented generally at 753 propagating in a second volume, which extends between the second-interface aperture 208 on the top surface 131 of the second waveguide 130 and an opposing bottom surface 132 of the second waveguide 130, are rotated. After propagation through the second volume (also referred to herein as a second transition region), the E fields 754 begin to propagate in normal waveguide TE10 mode of propagation in the region 133 in the second waveguide 120. This is indicated in FIG. 2D by the Poynting vector 755 (vector S) in the region 133 in the second waveguide 130.

Figure 3A:
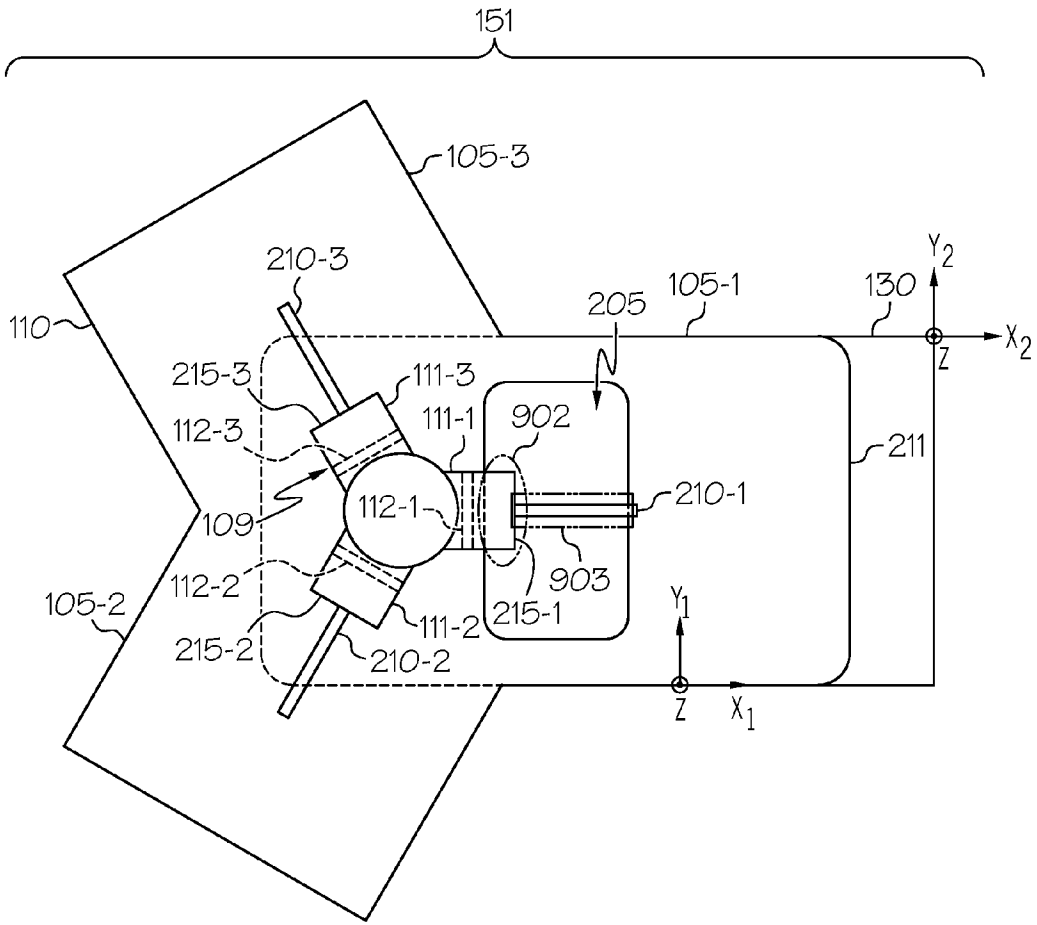
FIGS. 3A-3C are block diagrams illustrating top, oblique, and side views, respectively, of a waveguide circulator system in accordance with one embodiment.
Figure 3B:
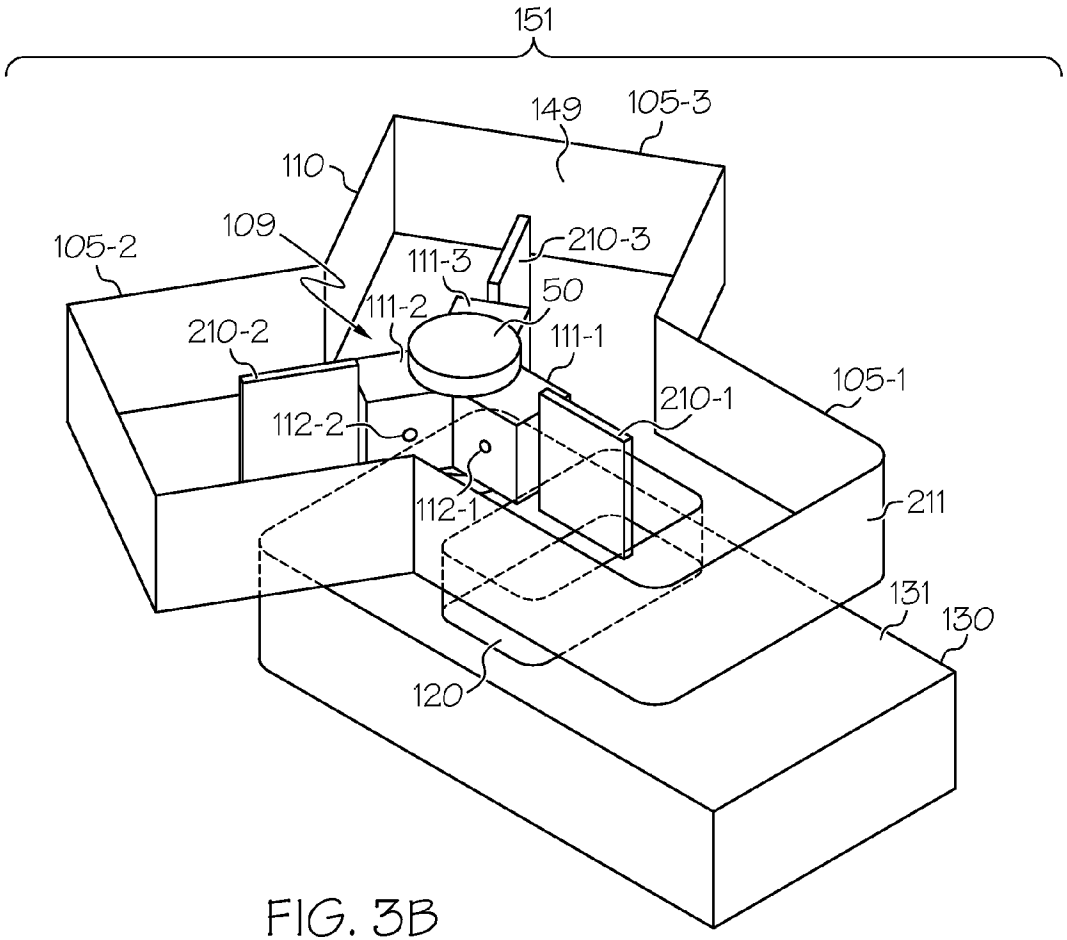
Figure 3C:
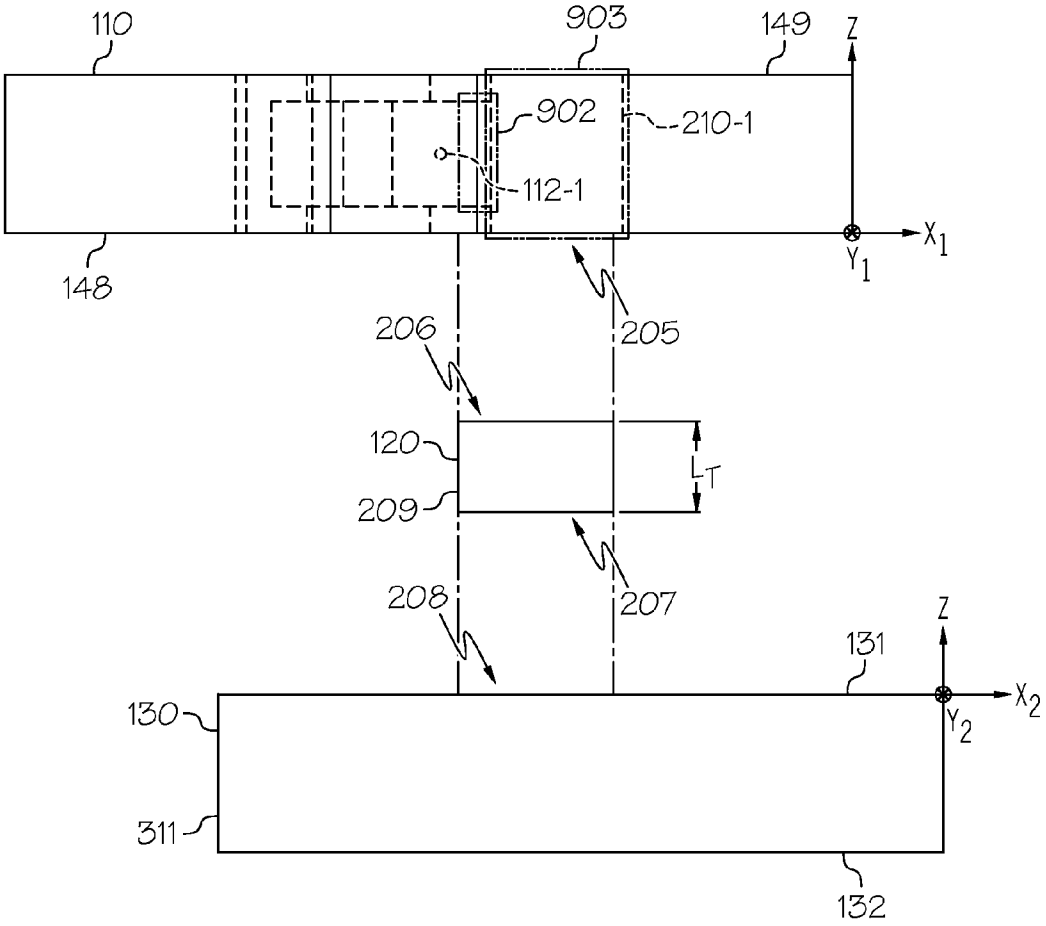

FIGS. 3A-3C are block diagrams illustrating top, oblique, and side views, respectively, of a waveguide circulator system 151 in accordance with one embodiment. The waveguide circulator system 151 includes the components of the waveguide circulator system 150 of FIGS. 2A-2B and also includes N quarter-wave dielectric transformers 210(1-N) attached to respective ends 215(1-N) of the N segments 111 (1-N) of the ferrite element 109. As shown in FIGS. 3A-3C, N is equal to three so three quarter-wave dielectric transformers 210(1-3) are attached to the ends 215(1-3) of the segments 111(1-3) in waveguide circulator system 151. The elements of FIG. 3C are shown in a side view, in which the first waveguide 110, the E-plane-transition waveguide 120, and the second waveguide 130 are separated along the Z direction in order to clearly indicate the apertures 205-208.

A first quarter-wave dielectric transformer 210-1 is attached to the end 215-1 of the first segment 111-1 of the ferrite element 109. A second quarter-wave dielectric transformer 210-2 is attached to the end 215-2 of the second segment 111-2 of the ferrite element 109. A third quarter-wave dielectric transformer 210-3 is attached to the end 215-3 of the third segment 111-3 of the ferrite element 109.

As shown in FIGS. 3A and 3C, a portion 903 of the first quarter-wave dielectric transformer 210-1 protrudes into the volume (a first transition region) that extends between the first-interface aperture 205 on the bottom surface 148 of the first waveguide arm 105-1 and an opposing top surface 149 of the first waveguide arm 105-1 and at least a portion 902 of the first segment 111-1 of the ferrite element 109 protrudes into the volume. Thus, the first waveguide 110 is shorter in the $X_1$ direction than the prior art first waveguide 56 (FIGS. 1A-1C) in the $X_1$ direction and the size, mass, and insertion loss (ohmic loss) of the waveguide circulator system 151 is less than that of the prior art waveguide system 50. In the direction of propagation of the electro-magnetic radiation, the impedance matching chain from the ferrite element 109 is reduced.

The function of the waveguide circulator system 151 is similar in function to the waveguide circulator system 150. The function of the ferrite element 109 is similar in function to the function of the ferrite element 109 in the waveguide circulator system 150 as described above with reference to FIGS. 2A-2B.

Figure 3D:
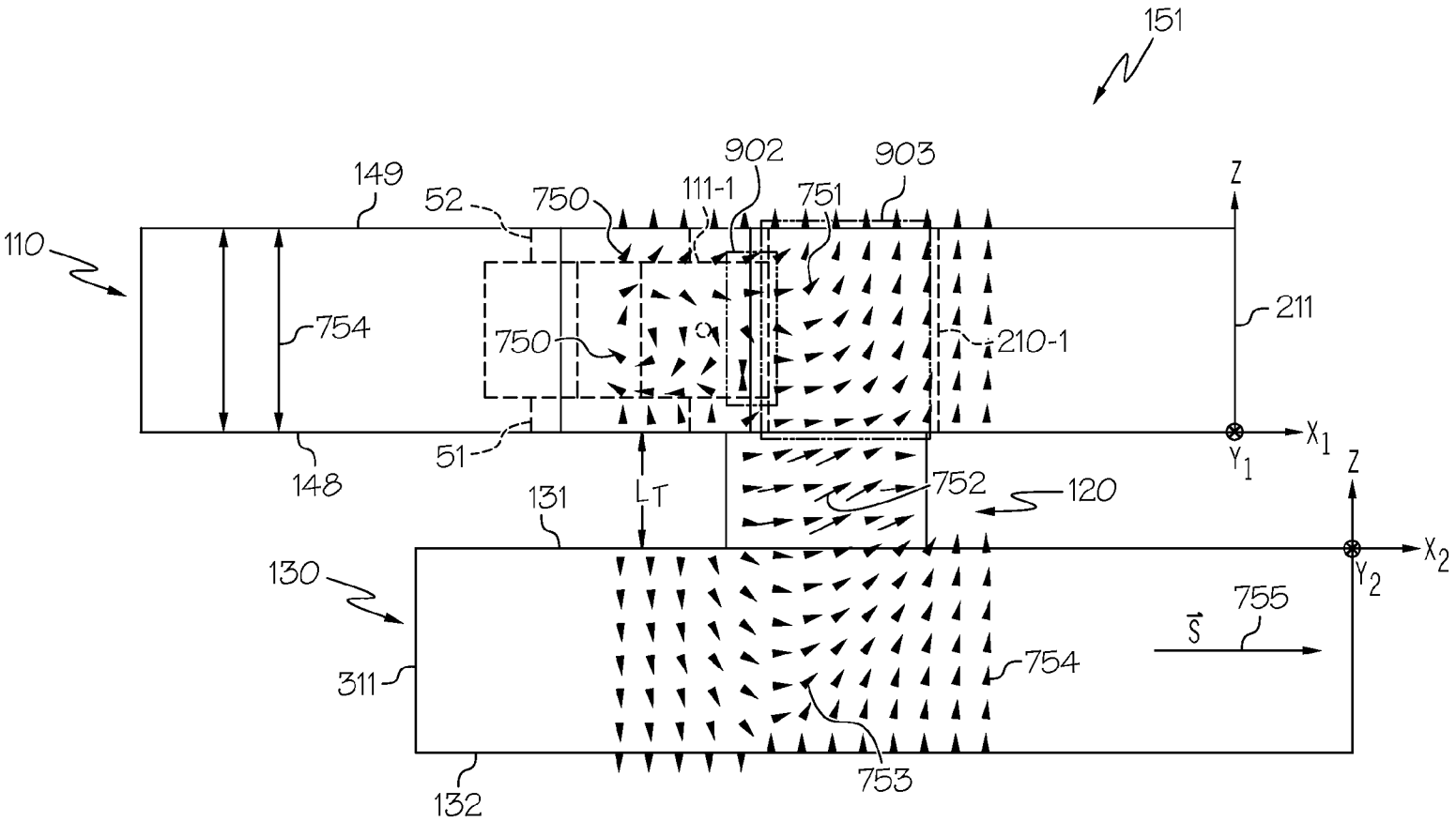
FIG. 3D shows the propagation of the E-field in the waveguide circulator system of FIGS. 3A-3C.

FIG. 3D shows the propagation of the E-field in the waveguide circulator system 151 of FIGS. 3A-3C. As described above with reference to the FIG. 2D, as the electro-magnetic radiation propagates through the ferrite element 109, the E-field vectors represented generally at 750 are not completely normal to the broad wall in the $X_1$-$Y_1$ plane of the first waveguide 110. After the electro-magnetic radiation is radiated from the first segment 111-1 of the ferrite element 109 and the first quarter-wave dielectric transformer 210-1, the E-field vectors represented generally at 751 are not settled out to being normal to the broad wall in the $X_1$-$Y_1$ plane. The E-field vectors 751 in the transition region (e.g., in the volume including the first quarter-wave dielectric transformer 210-1 that extends between the first-interface aperture 205 on the bottom surface 148 of the first waveguide arm 105-1 and an opposing top surface 149 of the first waveguide arm 105-1) are not all normal to the bottom surface 148 or the top surface 149.

However, as shown in FIG. 3D, the propagation effects described above with reference to the FIG. 2D are essentially the same. Likewise, as described above with reference to the FIG. 2D, the length $L_T$ of the E-plane-transition waveguide 120 is based on the impedance mismatch at the T junction, and the distance to the backshorts 211 and 311 in first waveguide 110 and second waveguide 130, respectively, and the length $L_T$ of the E-plane-transition waveguide 120. The distance to the backshorts 211 and 311 in first waveguide 110 and second waveguide 130, respectively, and the length $L_T$ of the E-plane-transition waveguide 120 are designed to match the impedance into and out of the E-plane-transition waveguide 120, with the first quarter-wave dielectric transformer 210-1 in the transition region, to ensure maximum power transfer from the ferrite element 109 and second waveguide 130.

Figure 4A:
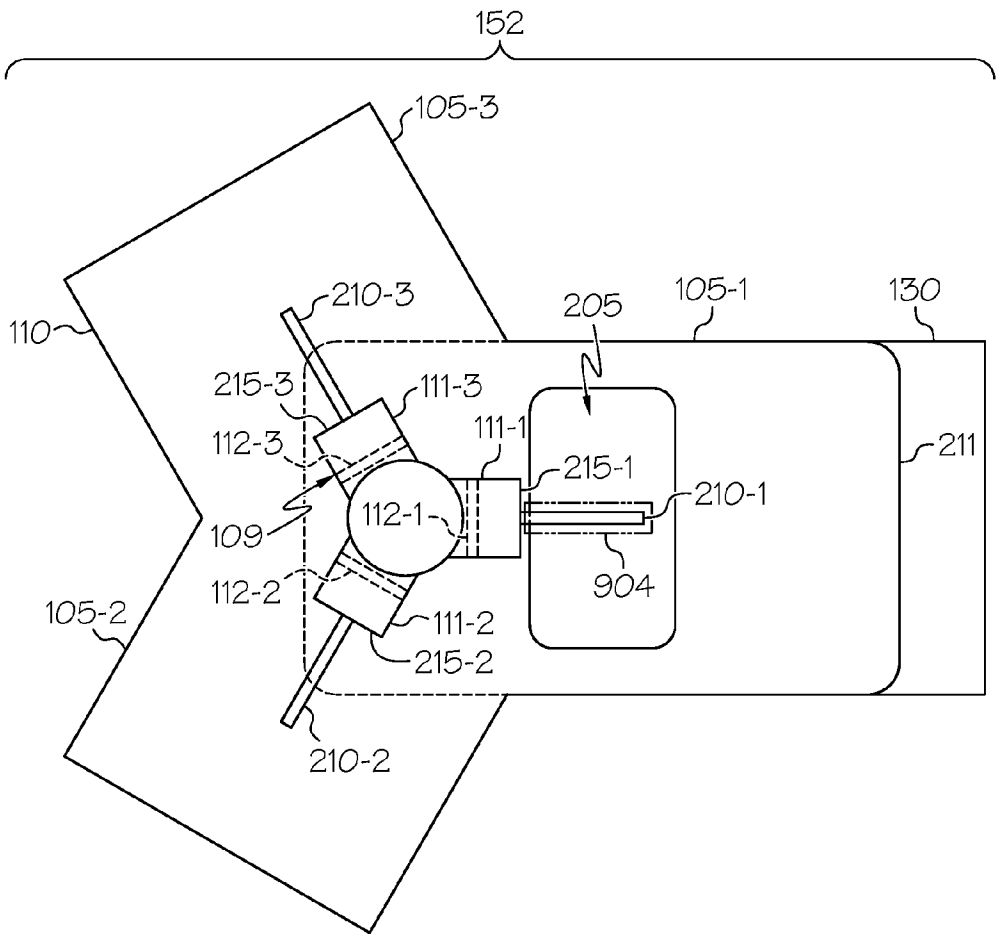
FIGS. 4A-4C are block diagrams illustrating top, oblique, and side views, respectively, of a waveguide circulator system in accordance with one embodiment.
Figure 4B:
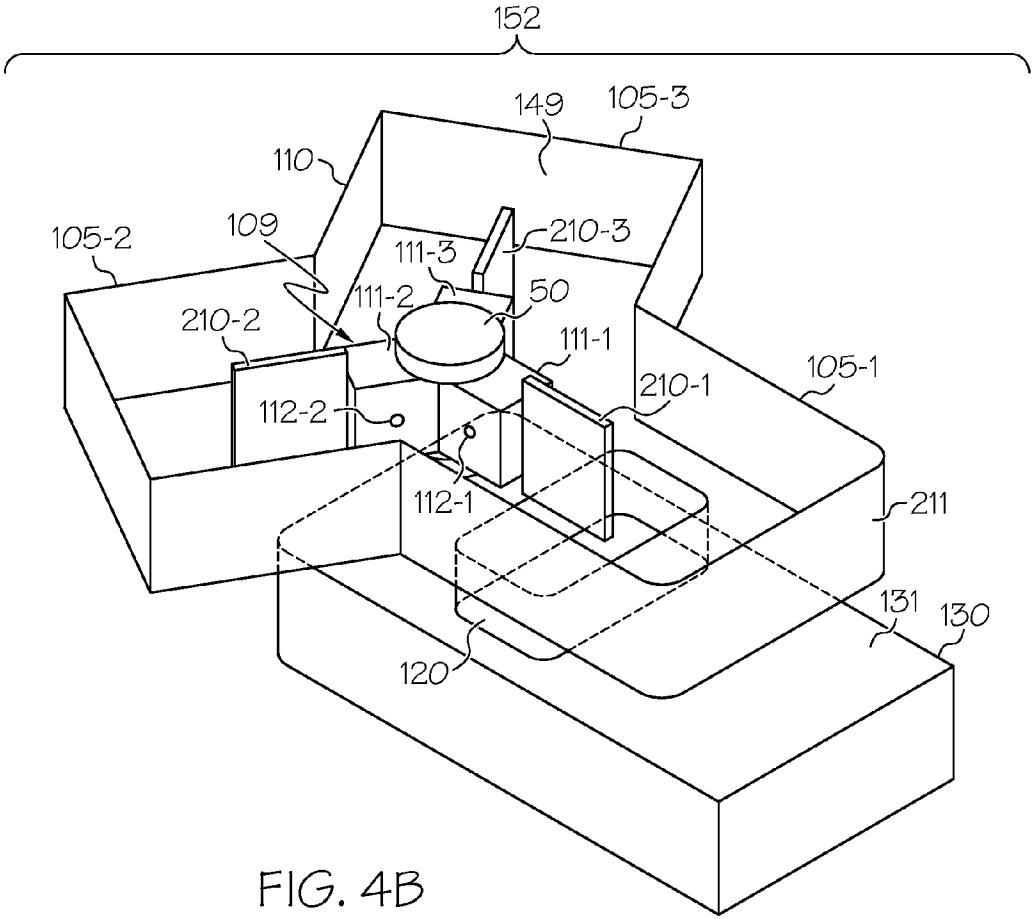
Figure 4C:
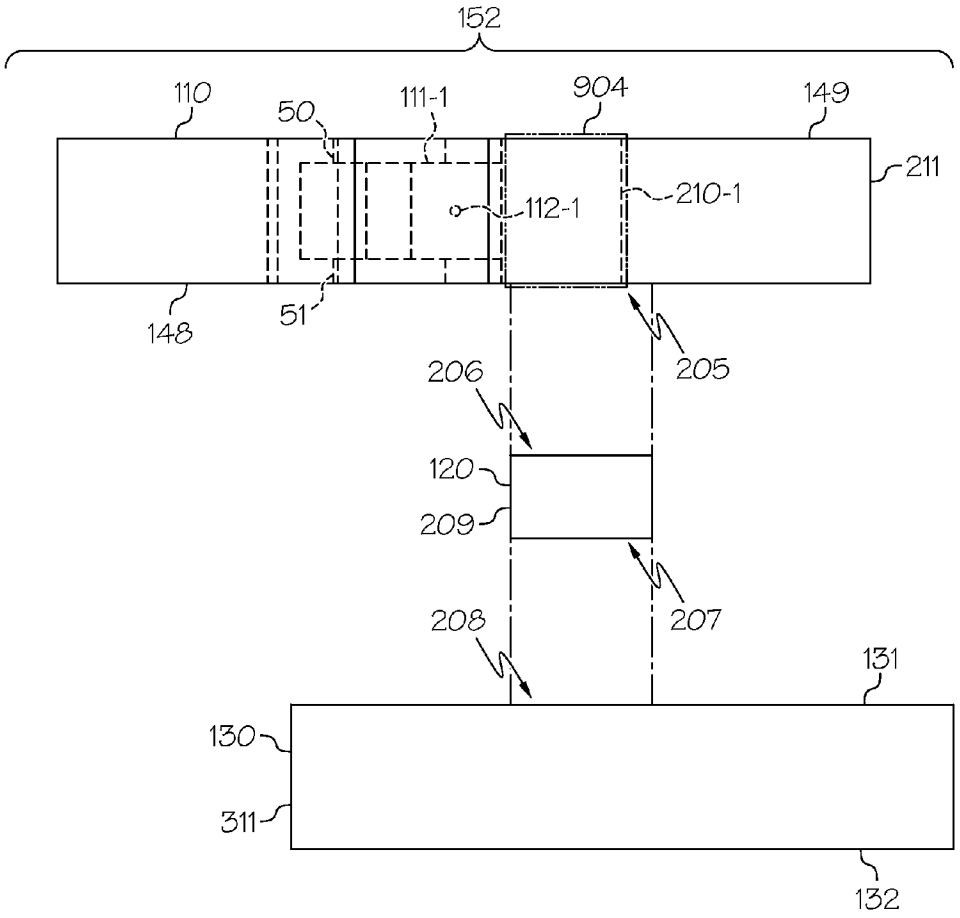

FIGS. 4A-4C are block diagrams illustrating top, oblique, and side views, respectively, of a waveguide circulator system 152 in accordance with one embodiment. The waveguide circulator system 152 for an E-plane-layer transition of an electro-magnetic field includes the components of the waveguide circulator system 151 of FIGS. 3A-3C.

FIGS. 4A-4C differ from FIGS. 3A-3C in that only a portion 904 of the first quarter-wave dielectric transformer 210-1 protrudes into a volume extending between the first-interface aperture 205 on the bottom surface 148 of the first waveguide arm 105-1 and an opposing top surface 149 of the first waveguide arm 105-1. The portion 902 of the first segment 111-1 of the ferrite element 109 that protruded into the volume in FIGS. 3A-3C is not protruding into the volume in FIGS. 4A-4C. The elements of FIG. 4C are shown in a side view, in which the first waveguide 110, the E-plane-transition waveguide 120, and the second waveguide 130 are separated along the Z direction in order to clearly indicate the apertures 205-208.

In FIGS. 4A-4C, the first waveguide 110 is shorter in the $X_1$ direction than the prior art first waveguide 56 (FIGS. 1A-1C) in the $X_1$ direction and the size, mass, and insertion loss (ohmic loss) of the waveguide circulator system 152 is less than that of the prior art waveguide system 50. In the direction of propagation of the electro-magnetic radiation, the impedance matching chain from the ferrite element 109 is reduced.

The function of the waveguide circulator system 152 is similar in function to the waveguide circulator systems 150 and 151. The function of the ferrite element 109 is similar in function to the function of the ferrite element 109 in the waveguide circulator systems 150 and 151 as described above with reference to FIGS. 2A-2C.

Figure 5A:
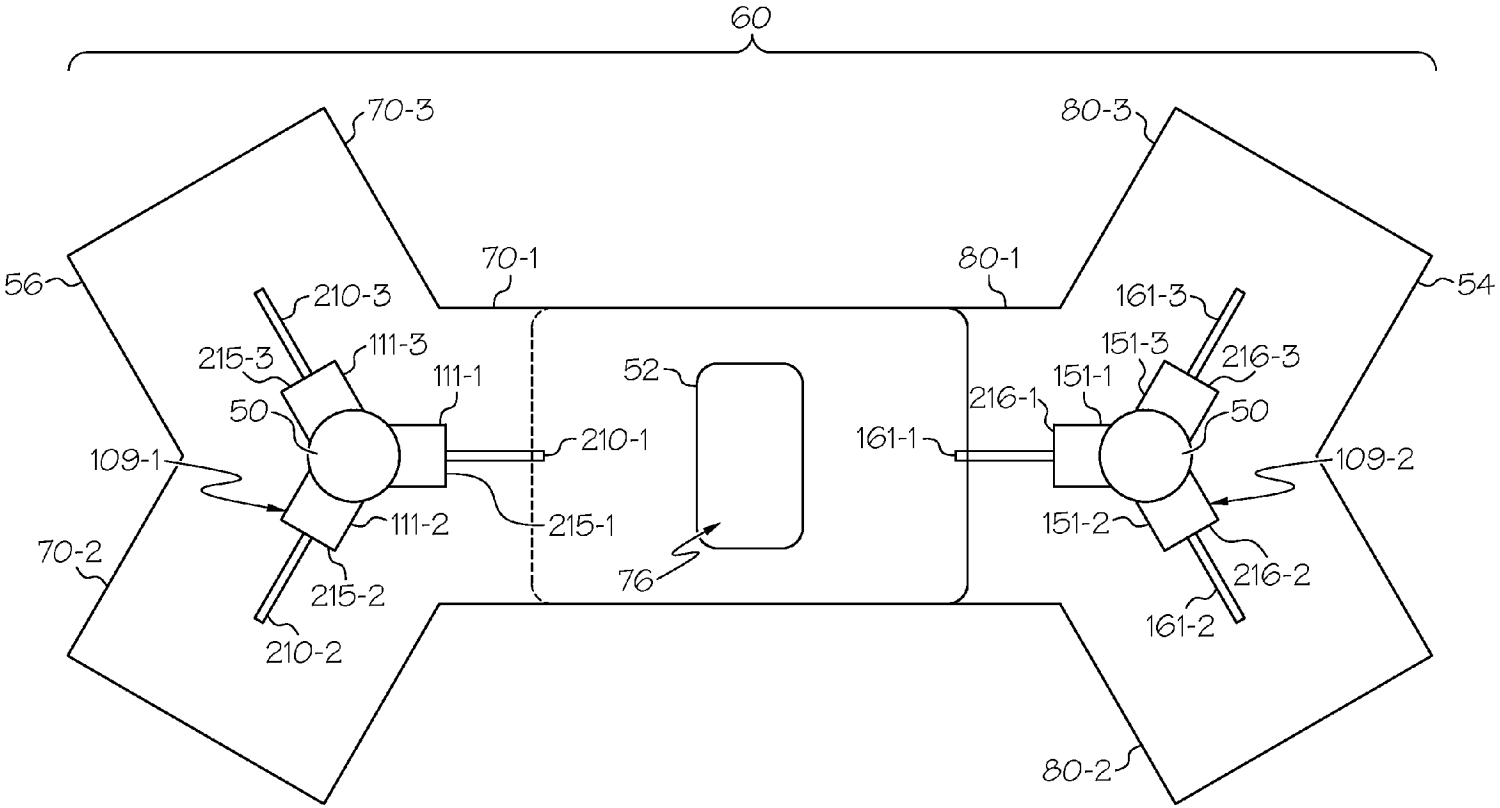
FIG. 5A (PRIOR ART)
FIGS. 5A-5C are block diagrams illustrating top, oblique, and side views, respectively, of a currently available waveguide circulator system.
Figure 5B:
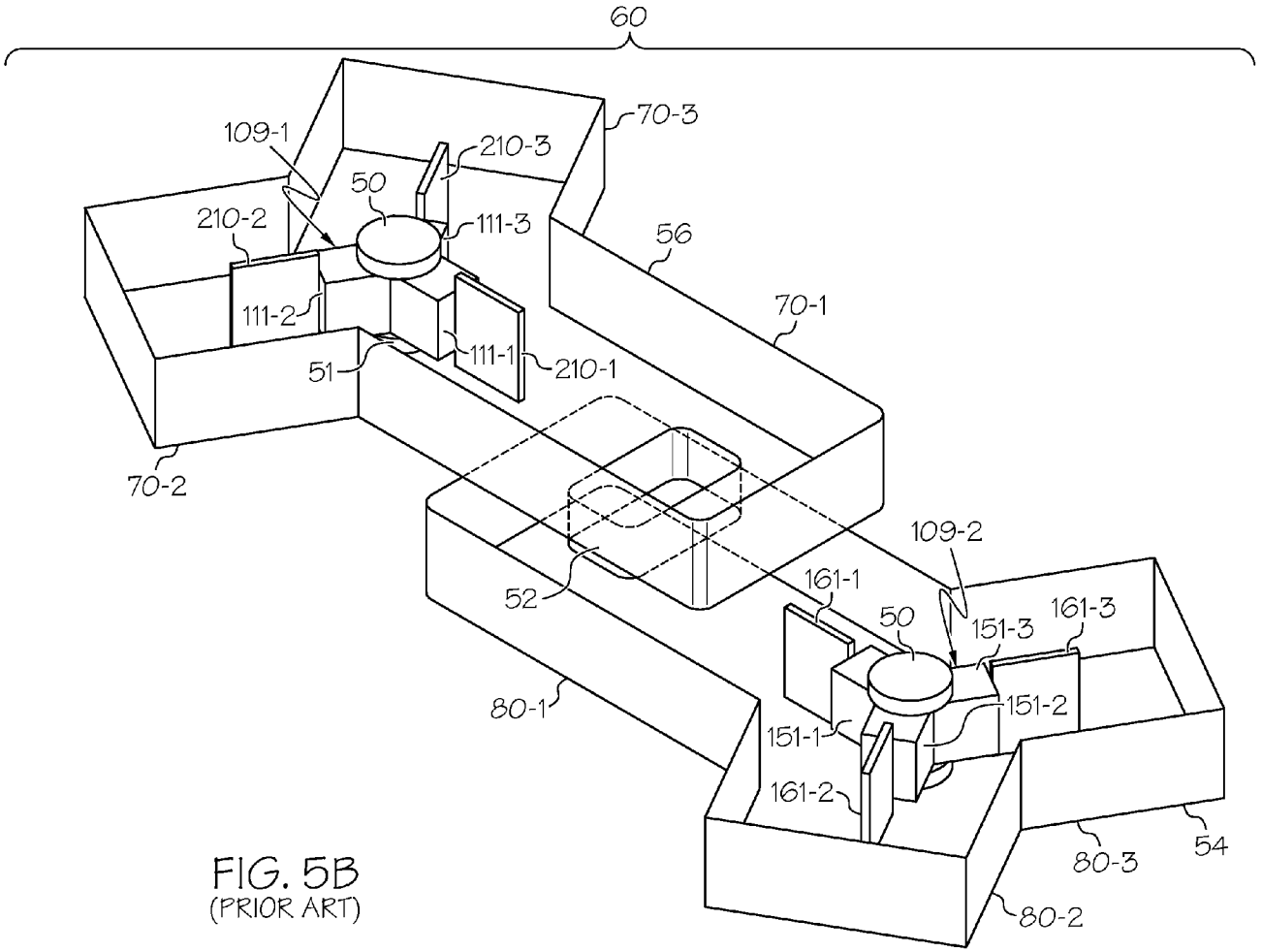
FIG. 5B (PRIOR ART)
Figure 5C:
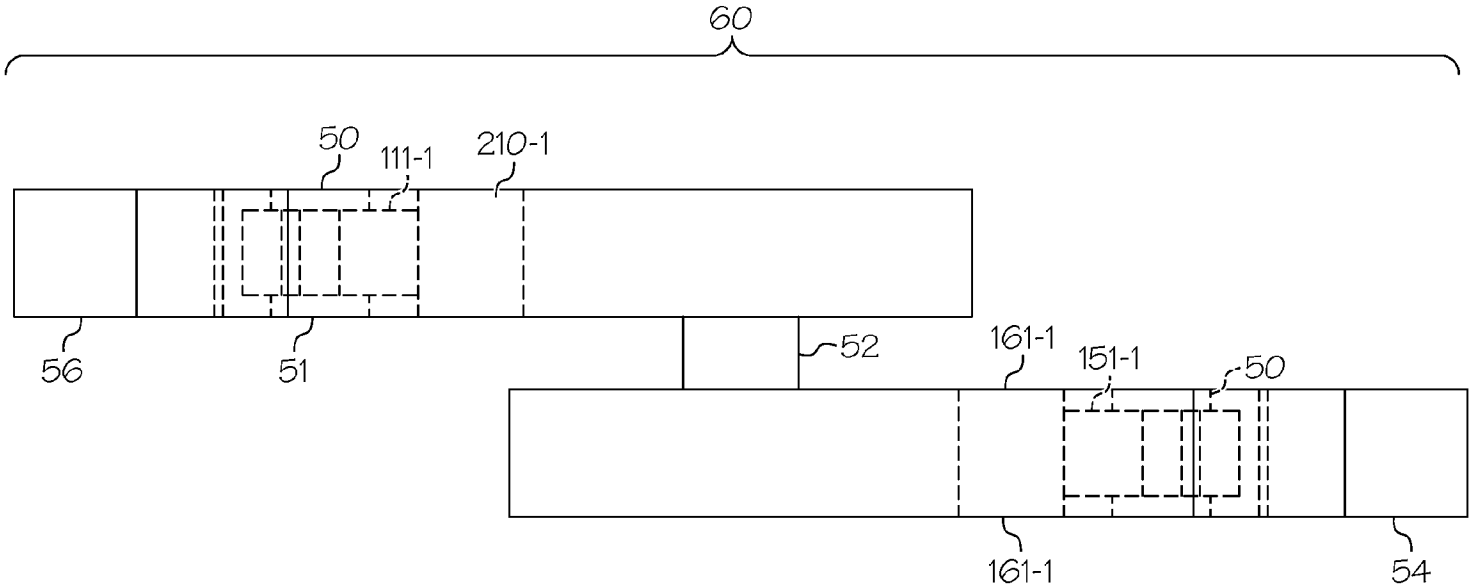
FIG. 5C (PRIOR ART)

Before describing the embodiments of FIGS. 6A-10C, a prior art waveguide circulator system 60 is described in order to emphasize the improved length available from the embodiments of waveguide circulator systems of FIGS. 6A-10C. FIGS. 5A-5C are block diagrams illustrating top, oblique, and side views, respectively, of a currently available waveguide circulator system 60. The waveguide circulator system 60 includes a first waveguide 56, an E-plane-transition waveguide 52, and a second waveguide 54. The prior art waveguide circulator system of FIGS. 5A-5C differ from the prior art waveguide circulator system of FIGS. 1A-1C in that the second waveguide 54 includes three waveguide arms 80(1-3). The waveguide circulator system 60 includes a second-ferrite element 109-2 having three segments 151(1-3) protruding into the three respective waveguide arms 80(1-3) of the second waveguide 54. If the currently available waveguide circulator system 60 includes any backshort, that backshort is about a quarter-wavelength (λ/4) from the aperture to the E-plane-transition waveguide 52 and at least λ/2 from the end (distal from the ferrite element 109) of the quarter-wave dielectric transformer 210-1.

Figure 6A:
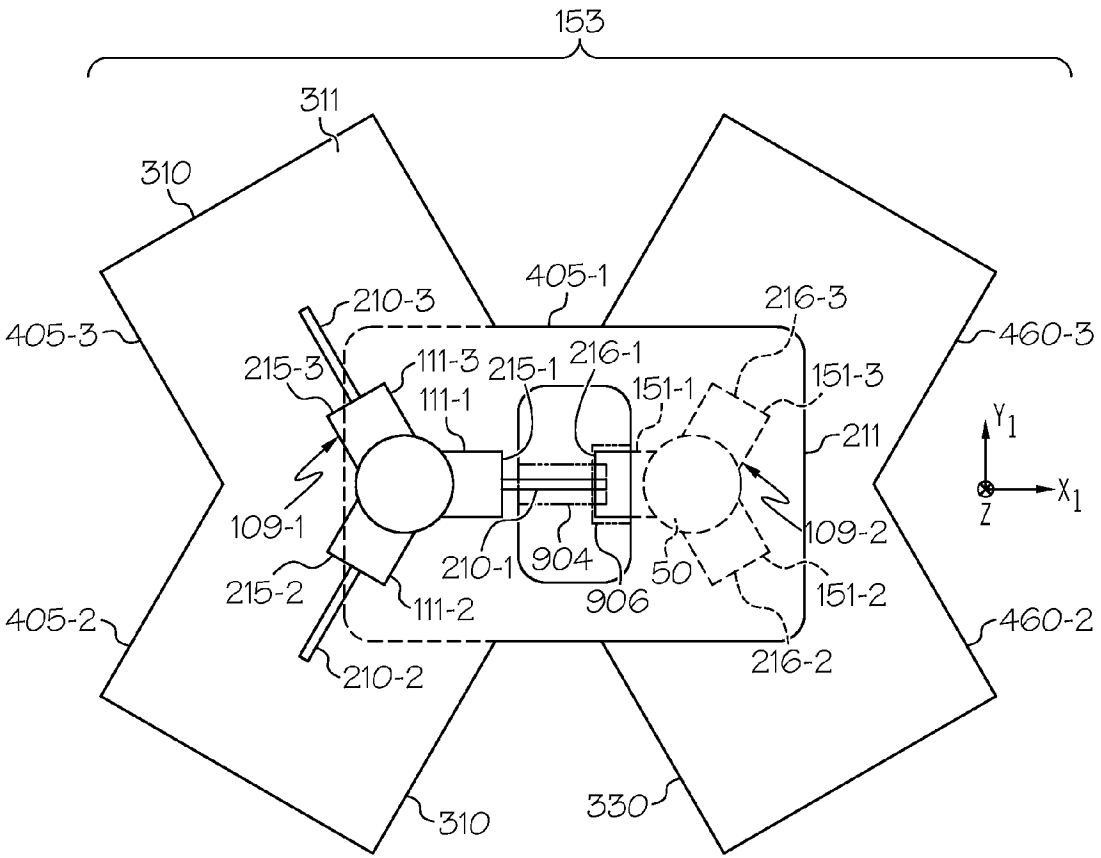
FIGS. 6A-6C are block diagrams illustrating top, oblique, and side views, respectively, of a waveguide circulator system in accordance with one embodiment.
Figure 6B:
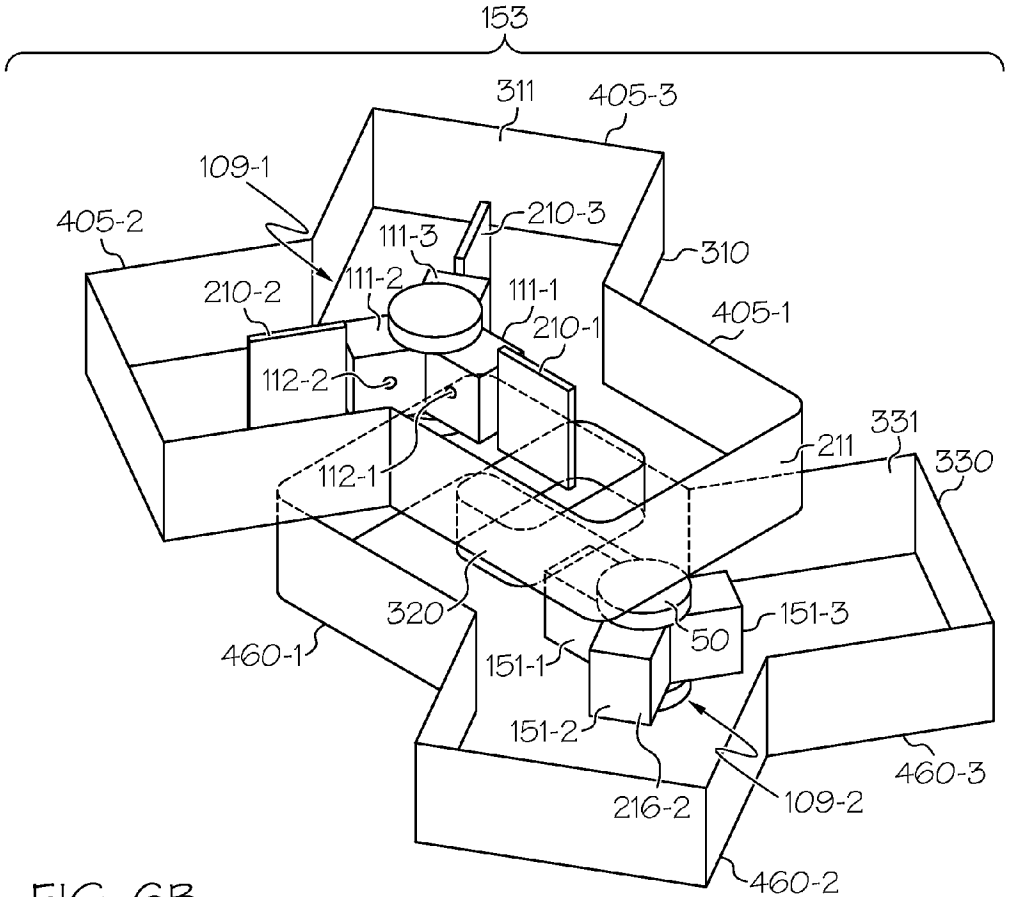
Figure 6C:
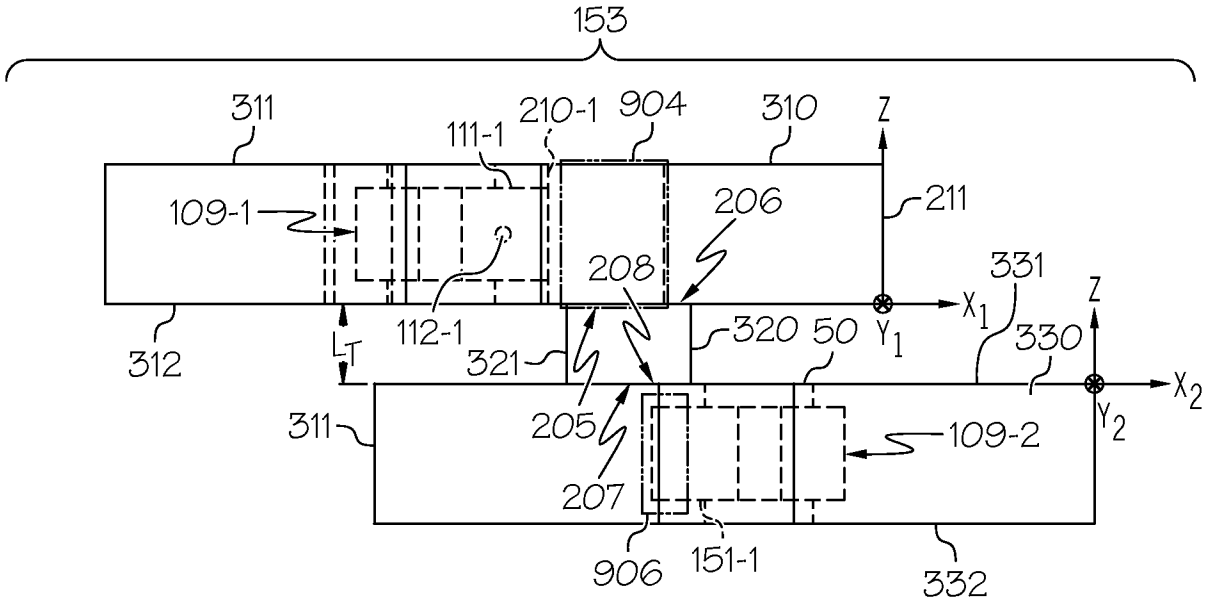

FIGS. 6A-6C are block diagrams illustrating top, oblique, and side views, respectively, of a waveguide circulator system 153 in accordance with one embodiment. The waveguide circulator system 153 includes a first waveguide 310, a first-ferrite element 109-1 arranged within the first waveguide 310, an E-plane-transition waveguide 320, a second waveguide 330, and a second-ferrite element 109-2 arranged within the second waveguide 330. The first waveguide 310 is on a first circulator layer. The second waveguide 330 is on a second circulator layer, which is offset from the first circulator layer by the length $L_T$ of an E-plane transition waveguide 320.

The first waveguide 310, the E-plane-transition waveguide 320, and the second waveguide 330 are conductive. The first waveguide 310 includes at least N waveguide arms 405(1-N), where N is a positive integer. As shown in the drawings N equals 3 but other values for N are possible. The waveguide arms 405(1-3) include a first waveguide arm 405-1, a first-other waveguide arm 405-2, and a second-other waveguide arm 405-3. A first-interface aperture 205 (similar to that shown in FIGS. 2A and 2C) spans a first $X_1$-$Y_1$ plane on a bottom surface 312 of the first waveguide arm 405-1 of the first waveguide 310. A backshort 211 (e.g., a waveguide wall 211) spans a $Y_1$-Z plane at an end of the first waveguide arm 405-1. The backshort 211 is positioned about a quarter of the wavelength (λ/4) from the first-interface aperture 205.

The first-ferrite element 109-1 has N segments 111(1-N) protruding into the N respective waveguide arms 405(1-N) of the first waveguide 310. The three segments 111(1-3) include a first segment 111-1 protruding into the first waveguide arm 405-1 of the first waveguide 310. The three segments 111(1-3) also include a first-other segment 111-2 that protrudes into the first-other waveguide arm 405-2, and a second-other segment 111-3 that protrudes into the second-other waveguide arm 405-3. The length of the first-waveguide arm 405-1 is optimized to maximize the transfer of energy from the first segment 111-1 to the E-plane-transition waveguide 320. In one implementation of this embodiment, the backshort 211 is about λ/4 from the first-interface aperture 205.

Quarter-wave dielectric transformers 210(1-N) are attached to respective ends 215(1-N) of the N segments 111 (1-N) of the first-ferrite element 109-1. As shown in FIGS. 6A-6C, three quarter-wave dielectric transformers 210(1-3) are attached to the ends 215(1-3) of the three segments 111 (1-3) in waveguide circulator system 153. The E-plane-transition waveguide 320 is similar in structure and function to the E-plane-transition waveguide 120 described above with reference to FIGS. 2A-2C.

The second waveguide 330 includes at least N waveguide arms 460(1-N), where N is a positive integer. As shown in the drawings N equals 3 but other values for N are possible. The waveguide arms 460(1-3) include a second waveguide arm 460-1, a first-other waveguide arm 460-2, and a second-other waveguide arm 460-3. The second waveguide arm 460-1 includes a second-interface aperture 208 similar to that shown in the second waveguide shown in FIG. 2C. The top surface 331 of the second waveguide arm 460-1 spans a second $X_2$-$Y_2$ plane. The second waveguide arm 460-1 includes a bottom surface 332 opposing the top surface 331. The first $X_1$-$Y_1$ plane is offset from the second $X_2$-$Y_2$ plane along a Z axis (Z) by the length $L_T$ of the E-plane-transition waveguide 320. The second waveguide 330 includes a backshort 311 in the $Y_2$-Z plane. The backshort 311 spans a $Y_2$-Z plane at an end of the second waveguide arm. The backshort is positioned about a quarter of the wavelength ($\lambda/4$) from the second-interface aperture 208.

The second-ferrite element 109-2 has M segments 151(1-M) protruding into the M respective waveguide arms 460(1-M) of the second waveguide 330, wherein a second segment 151-1 of the second-ferrite element 109-2 protrudes into the second waveguide arm 460-1, wherein at least a portion 906 of the second segment 151-1 of the second-ferrite element 109-2 protrudes into a second volume extending between the second-interface aperture 208 on the top surface 331 of the second waveguide arm 460-1 and an opposing bottom surface 332 of the second waveguide arm 460-1. The perspective of the FIG. 6B is such that the second segment 151-1 of the second-ferrite element 109-2 does not appear to be in the second volume, but FIGS. 6A and 6C, clearly show that the second-ferrite element 109-2 protrudes into the second volume. There are no quarter-wave dielectric transformers attached to respective ends 216(1-N) of the N segments 151 (1-N) of the second-ferrite element 109-2 in the waveguide circulator system 153.

The first-interface aperture 205 is arranged to proximally overlap the first open-end 206 of the E-plane-transition waveguide 320. The second open-end 207 of the E-plane-transition waveguide 320 is approximately the same shape as the second second-interface aperture 208 of the second waveguide 330. The second-interface aperture 208 is arranged to proximally overlap the second open-end 207.

At least a portion 904 (FIGS. 6A and 6C) of the first quarter-wave dielectric transformer 210-1 protrudes into a volume that extends between the first-interface aperture 205 on the bottom surface 312 of the first waveguide arm 405-1 and an opposing top surface 311 of the first waveguide arm 405-1. This volume is also referred to herein as the "transition region." Thus, the first waveguide 310 is shorter in the $X_1$ direction than the prior art first waveguide 54 (FIGS. 5A-5C) in the $X_1$ direction. Therefore, the size, mass, and insertion loss (ohmic loss) of the waveguide circulator system 153 is less than that of the prior art waveguide system 60. In the direction of propagation of the electro-magnetic radiation, the impedance matching chain from the first-ferrite element 109-1 and the second-ferrite element 109-2 is reduced. In one implementation of this embodiment, the wavelength of the electro-magnetic radiation propagating in the waveguide circulator system 153 is in the range of radio frequency (RF) wavelengths. In another implementation of this embodiment, the wavelength of the electro-magnetic radiation propagating in the waveguide circulator system 153 is in the range of microwave frequency wavelengths.

The first-ferrite element 109-1 can be other shapes as well. The first-ferrite element 109-1 and second-ferrite element 109-2 are similar in structure and function to the ferrite element 109 described above with reference to FIGS. 2A-4C. In further embodiments, dielectric spacers 50 and 51 are disposed on the first-ferrite element 109-1 and second-ferrite element 109-2 as described above with reference to FIGS. 2A-4C.

In at least one exemplary embodiment, the first waveguide-arm 405-1 functions as an output arm and one of the two other waveguide arms 405-2 or 405-3 functions as an input arm. The input waveguide arm 405-1 propagates the electro-magnetic field into the E-plane-transition waveguide 320 as described above with reference to FIGS. 2D and 3D. A microwave signal or an RF signal received from an input waveguide arm 405-2 or 405-3 can be routed with a low insertion loss from the one waveguide arm 405-2 or 405-3 to the output waveguide arm 405-1. When the magnetic fields in the first-ferrite element 109-1 are changed, the first waveguide-arm 405-1 functions as an input arm and one of the two other waveguide arms 405-2 or 405-3 functions as an output arm. In this case, the input waveguide arm 405-1 propagates the electro-magnetic field from the E-plane-transition waveguide 320 to one of the other waveguide arms 405-2 or 405-3. Thus, the first-ferrite element 109-1 has a selectable direction of circulation. As shown, the first-ferrite element 109-1 is a Y-shaped first-ferrite element 109-1. Other shapes are possible.

In at least one exemplary embodiment, the second waveguide-arm 460-1 functions as an input arm and one of the two other waveguide arms 460-2 or 460-3 functions as an output arm. The input waveguide arm 460-1 propagates the electro-magnetic field input from the E-plane-transition waveguide 320 as described above with reference to FIGS. 2D and 3D. A microwave signal or an RF signal received from the E-plane-transition waveguide 320 can be routed with a low insertion loss to one of the other waveguide arms 460-2 or 460-3. When the magnetic fields in the second-ferrite element 109-2 are changed, the first waveguide-arm 460-1 functions as an output arm and one of the two other waveguide arms 460-2 or 460-3 functions as an input arm. In this case, the output waveguide arm 460-1 propagates the electro-magnetic field to the E-plane-transition waveguide 320 from one of the other waveguide arms 460-2 or 460-3. Thus, the second-ferrite element 109-2 has a selectable direction of circulation. The directionality of propagation of the second-ferrite element 109-2 and the second-ferrite element 109-2 are coordinated so the electro-magnetic fields flow between the first waveguide 310 and the second waveguide 330. As shown, the second-ferrite element 109-2 is a Y-shaped first-ferrite element 109-2. Other shapes are possible.

The waveguide circulator system 153 is configured to guide electro-magnetic radiation propagating to the second waveguide 330 from the first waveguide 310 or vice versa. The propagating electro-magnetic radiation in waveguide circulator system 153 has an E-field vector pattern similar to that shown in FIGS. 2D and 3D, as is understandable to one skilled in the art. The waveguide circulator system 153 has reduced ohmic loss and reduced size and weight from the prior art waveguide circulator system 60 of FIGS. 5A-5C.

Figure 7A:
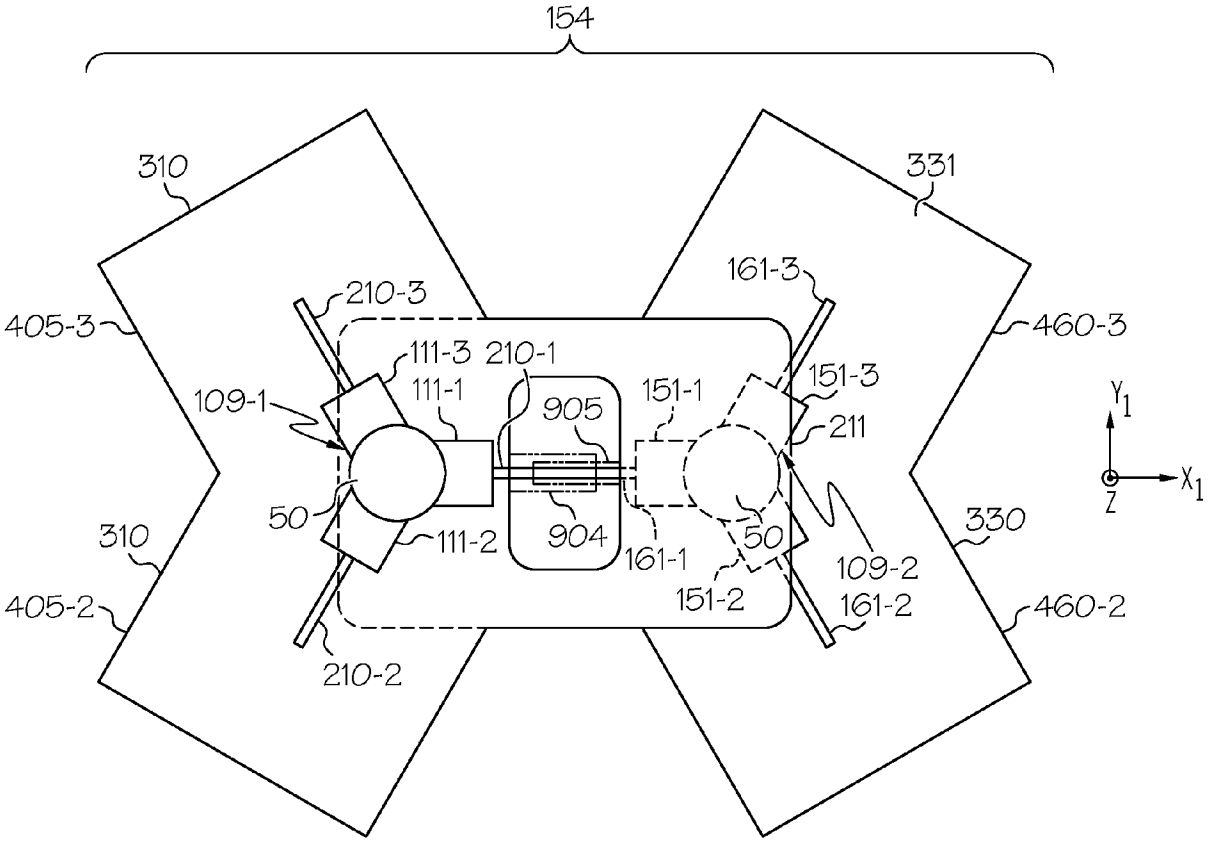
FIGS. 7A-7C are block diagrams illustrating top, oblique, and side views, respectively, of a waveguide circulator system in accordance with one embodiment.
Figure 7B:
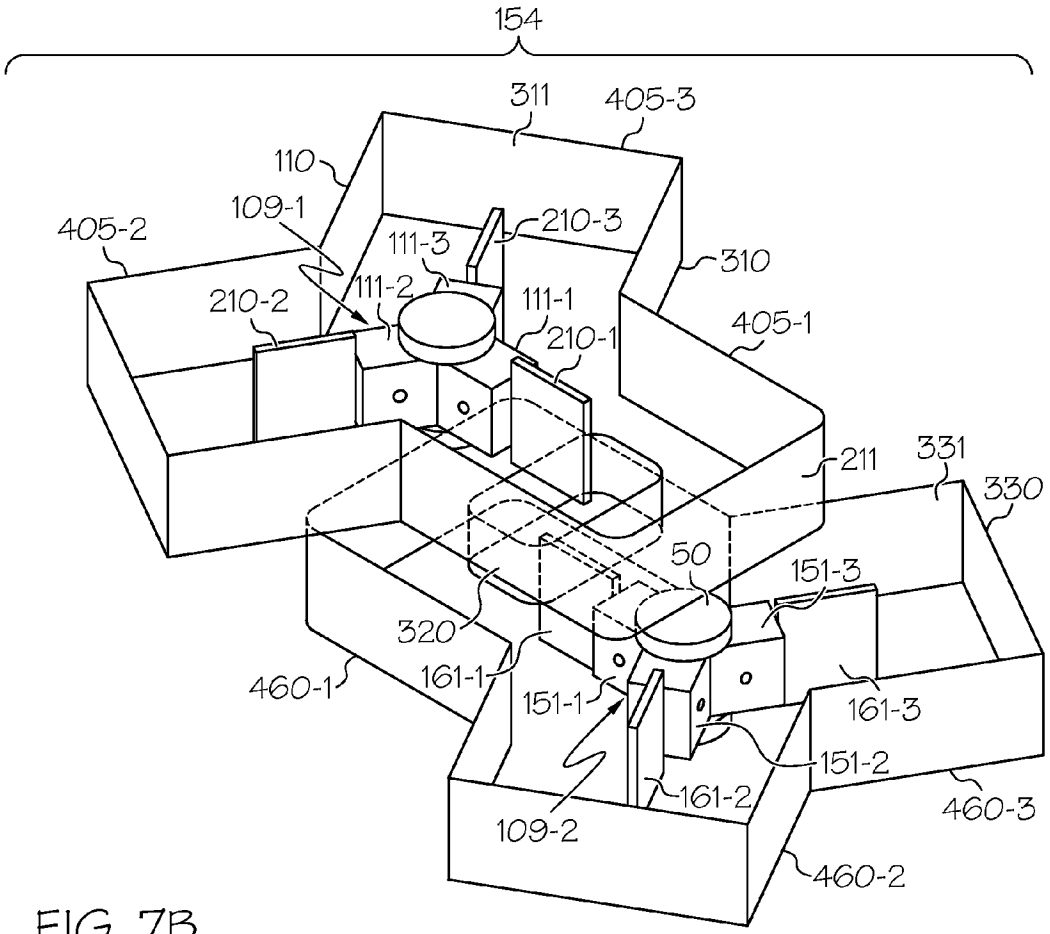
Figure 7C:
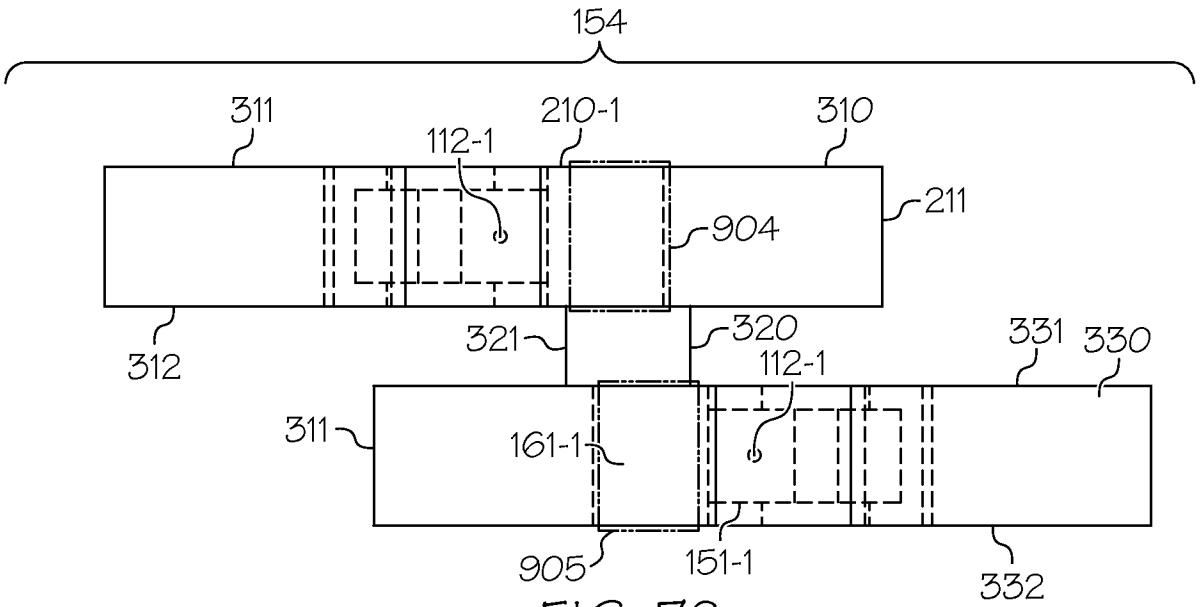

FIGS. 7A-7C are block diagrams illustrating top, oblique, and side views, respectively, of a waveguide circulator system 154 in accordance with one embodiment. The waveguide circulator system 154 differs from the waveguide circulator system 153 described above with reference to FIGS. 6A-6C in that quarter-wave dielectric transformers 161(1-3) are attached to respective ends of the three segments 151(1-3) of the second-ferrite element 109-2. A second quarter-wave dielectric transformer 161-1 is attached to a second segment 151-1 of the second-ferrite element 109-2. A quarter-wave dielectric transformer 161-2 is attached to a segment 151-2 of the second-ferrite element 109-2 and a quarter-wave dielectric transformer 161-3 is attached to a segment 151-3 of the second-ferrite element 109-2.

As shown in FIGS. 7A and 7C, the second quarter-wave dielectric transformer 161-1 and the second segment 151-1 protrude into the second waveguide arm 460-1 of the second waveguide 330. At least a portion 905 of the second quarter-wave dielectric transformer 161-1 protrudes into the second volume. At least a portion 904 of the first quarter-wave dielectric transformer 210-1 protrudes into the first volume.

The waveguide circulator system 154 is configured to guide electro-magnetic radiation propagating to the second waveguide 330 from the first waveguide 310 or vice versa. The propagating electro-magnetic radiation in waveguide circulator system 154 has an E-field vector pattern similar to that shown in FIGS. 2C and 2D, as is understandable to one skilled in the art. The waveguide circulator system 154 has reduced ohmic loss and reduced size and weight from the prior art waveguide circulator system 60 of FIGS. 5A-5C.

Figure 8A:
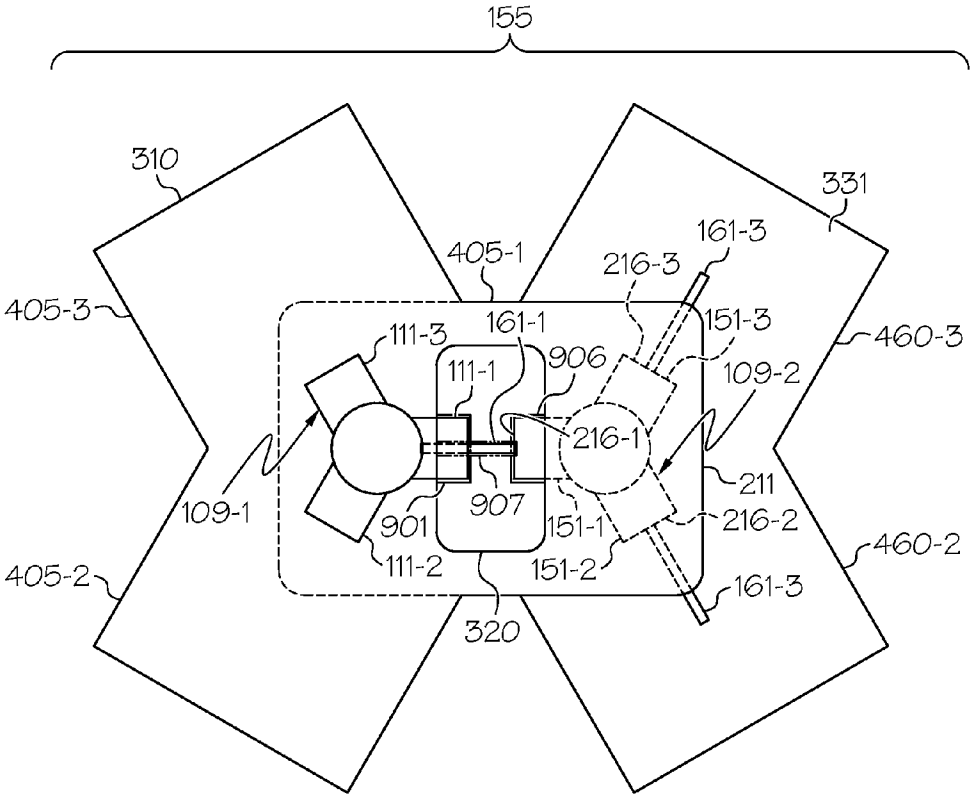
FIGS. 8A-8C are block diagrams illustrating top, oblique, and side views, respectively, of a waveguide circulator system in accordance with one embodiment.
Figure 8B:
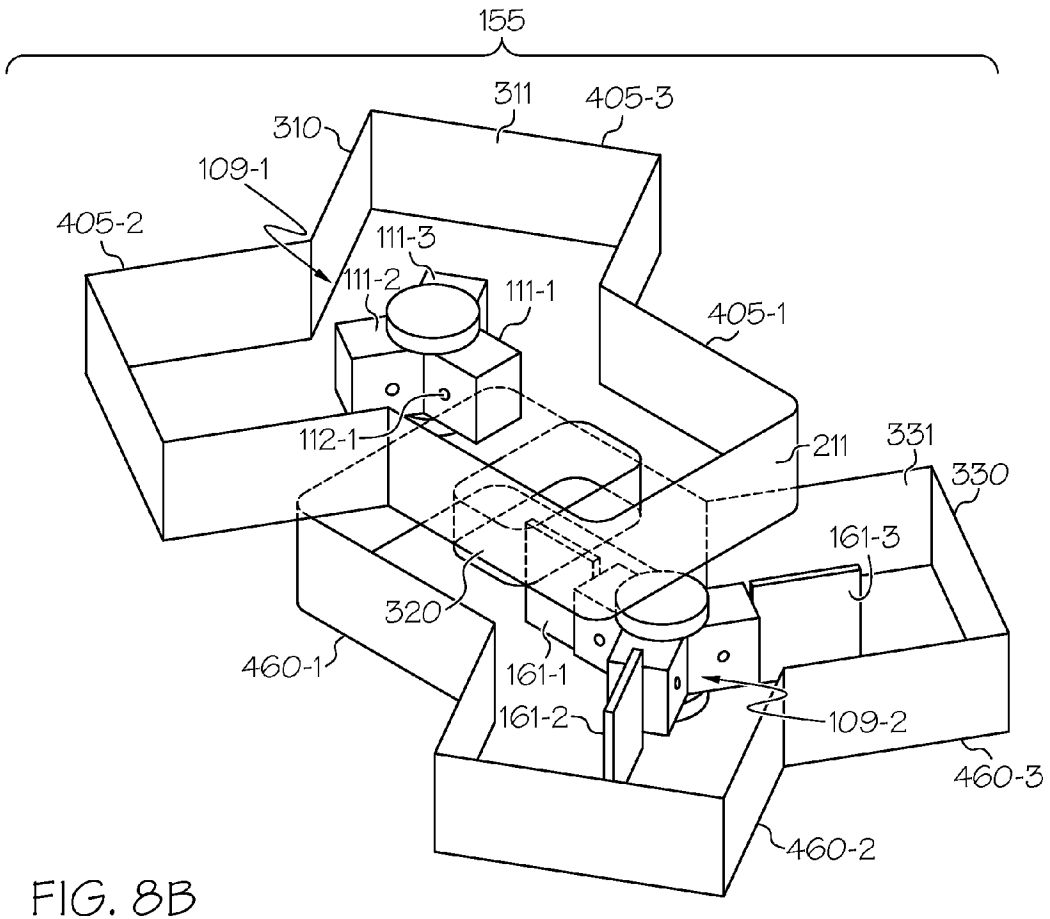
Figure 8C:
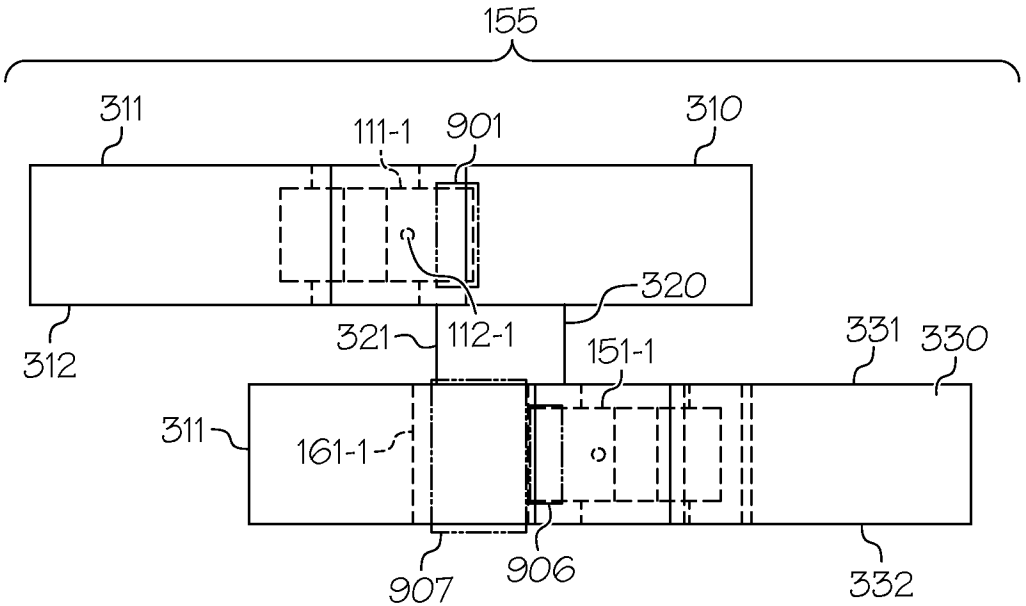

FIGS. 8A-8C are block diagrams illustrating top, oblique, and side views, respectively, of a waveguide circulator system 155 in accordance with one embodiment. The waveguide circulator system 155 differs from the waveguide circulator system 154 described above with reference to FIGS. 7A-7C in that there are no quarter-wave dielectric transformers 210 (1-3) attached to respective ends of the three segments 111 (1-3) of the first-ferrite element 109-1. As shown in FIGS. 8A and 8C, at least a portion 901 of the first segment 111-1 of the first-ferrite element 109-1 protrudes into the first volume. As shown in FIGS. 8A and 8C, at least a portion 906 of the first segment 151-1 of the second-ferrite element 109-2 protrudes into the second volume and at least a portion 907 of the second quarter-wave dielectric transformer 161-1 protrudes into the second volume. The perspective of the FIG. 8B is such that the first segment 111-1 of the first-ferrite element 109-1 does not appear to protrude into the first volume and the first segment 151-1 of the second-ferrite element 109-2 does not appear to protrude into the second volume but FIGS. 8A and 8C, clearly show that first segment 111-1 protrudes into the first volume and first segment 151-1 protrudes into the second volume.

The waveguide circulator system 155 is configured to guide electro-magnetic radiation propagating through to (or from) the second waveguide 330 from (or to) the first waveguide 310. The propagating electro-magnetic radiation in waveguide circulator system 155 has an E-field vector pattern similar to that shown in FIG. 2D, as is understandable to one skilled in the art. The waveguide circulator system 155 has reduced ohmic loss and reduced size and weight from the prior art waveguide circulator system 60 of FIGS. 5A-5C.

Figure 9A:
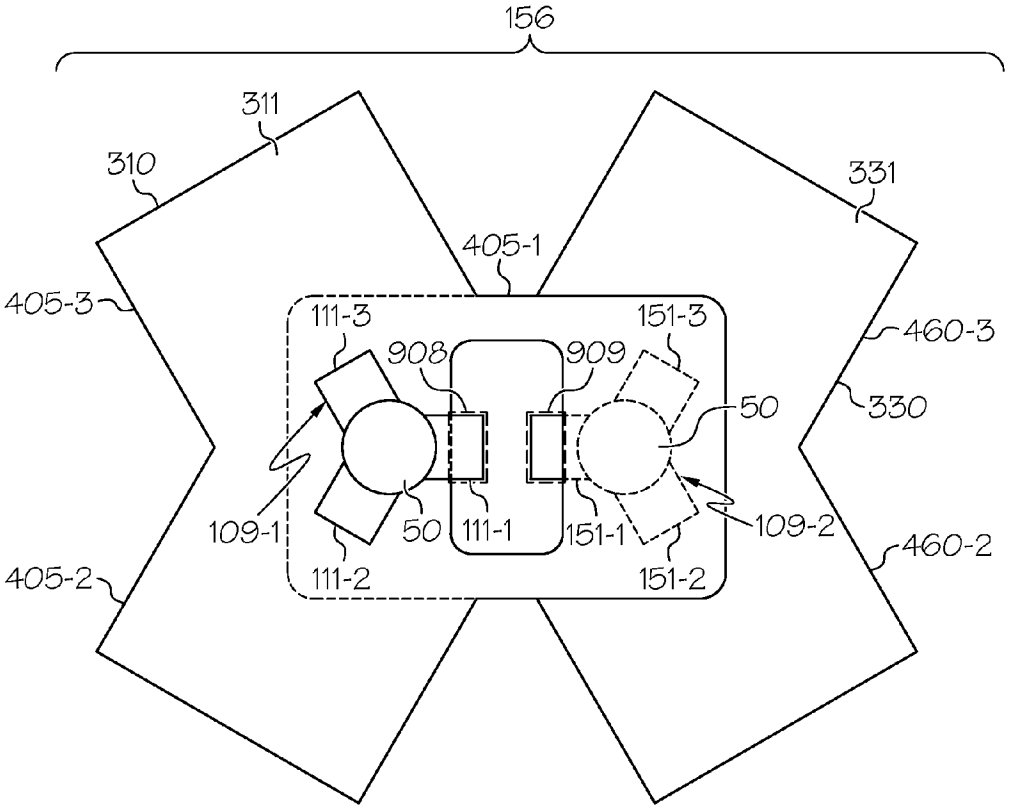
FIGS. 9A-9C are block diagrams illustrating top, oblique, and side views, respectively, of a waveguide circulator system in accordance with one embodiment.
Figure 9B:
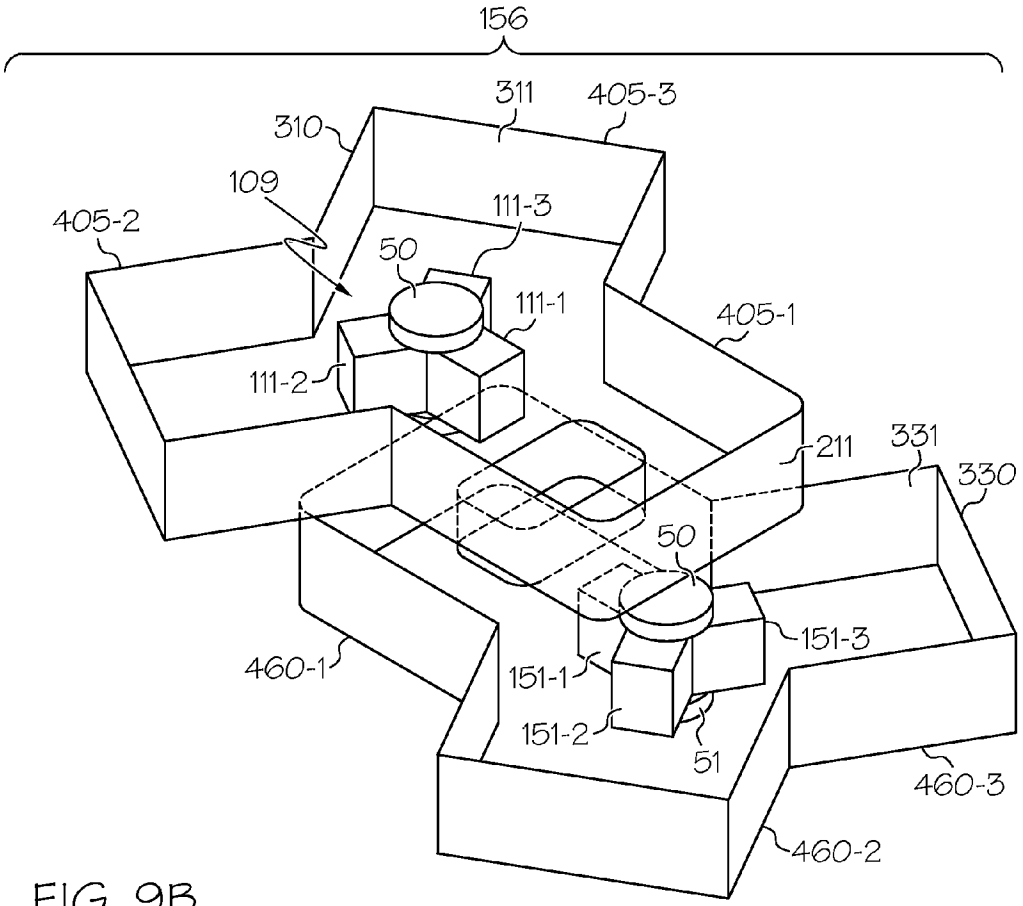
Figure 9C:
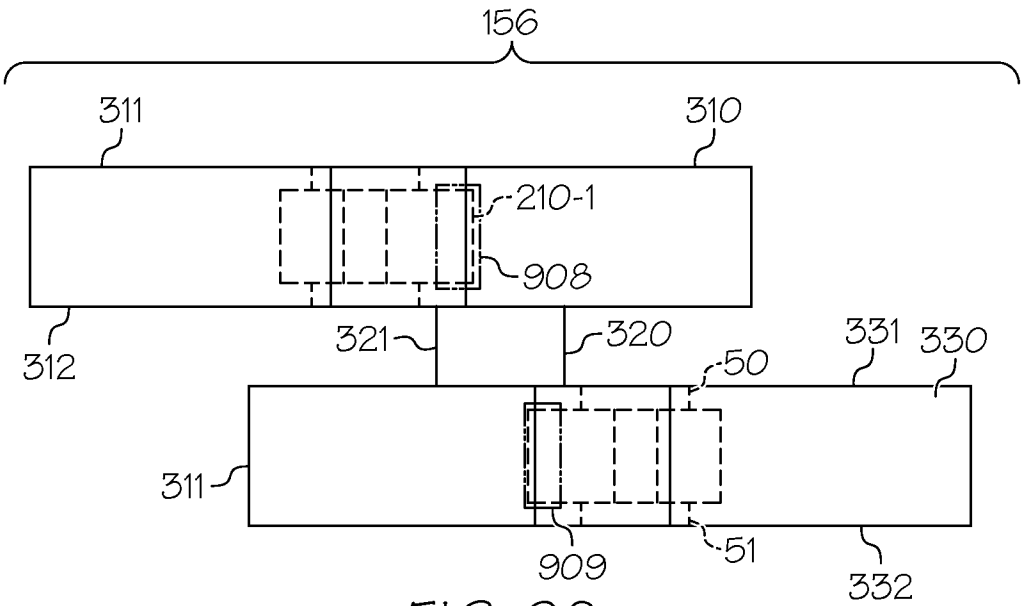

FIGS. 9A-9C are block diagrams illustrating top, oblique, and side views, respectively, of a waveguide circulator system 156 in accordance with one embodiment.

The waveguide circulator system 156 differs from differs from the waveguide circulator system 155 described above with reference to FIGS. 8A-8C in that there are no quarter-wave dielectric transformers 161(1-3) attached to respective ends 216(1-3) of the three segments 151(1-3) of the second-ferrite element 109-2. As shown in FIGS. 9A and 9C, at least a portion 908 of the first segment 111-1 of the first-ferrite element 109-1 protrudes into the first transition region (e.g., first volume). As shown in FIGS. 9A and 9C, at least a portion 909 of the first segment 151-1 of the second-ferrite element 109-2 protrudes into the second volume.

The waveguide circulator system 156 is configured to guide electro-magnetic radiation propagating to the second waveguide 330 from the first waveguide 310 or vice versa. The propagating electro-magnetic radiation in waveguide circulator system 156 has an E-field vector pattern similar to that shown in FIGS. 2D and 3D, as is understandable to one skilled in the art. The waveguide circulator system 156 has reduced ohmic loss and reduced size and weight from the prior art waveguide circulator system 60 of FIGS. 5A-5C.

Figure 10A:
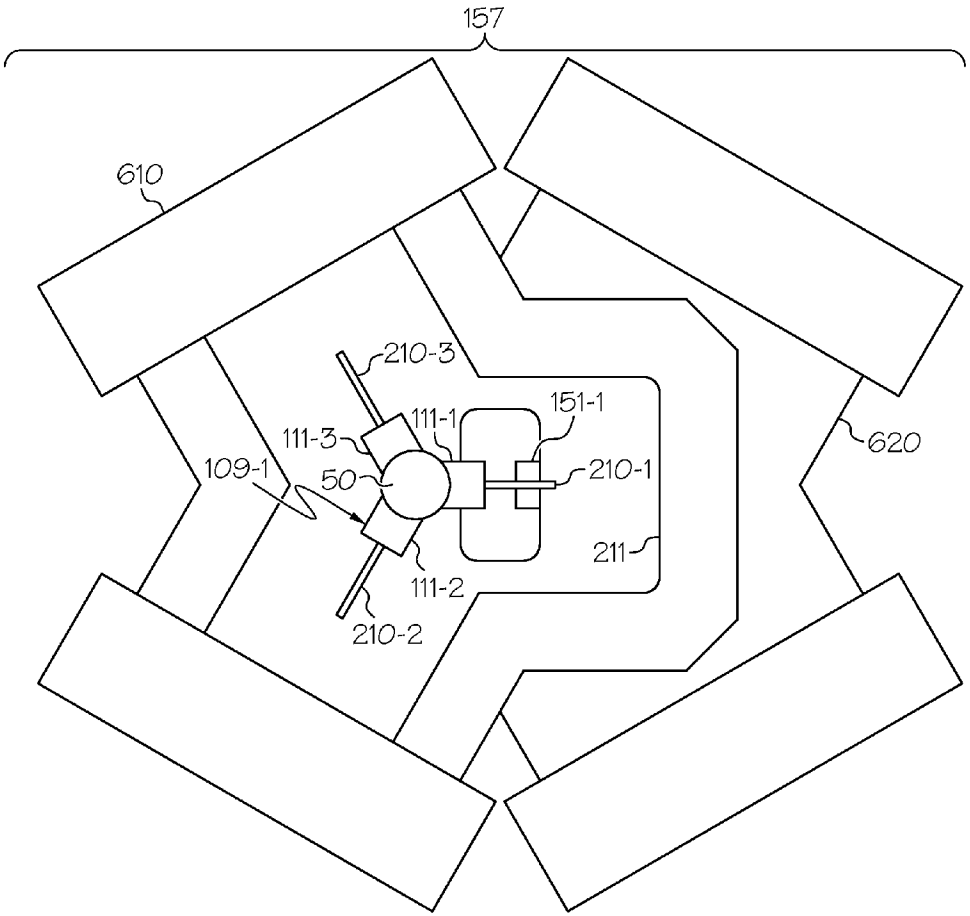
FIGS. 10A-10C are block diagrams illustrating top, oblique, and side views, respectively, of a waveguide circulator system in a housing in accordance with one embodiment.
Figure 10B:
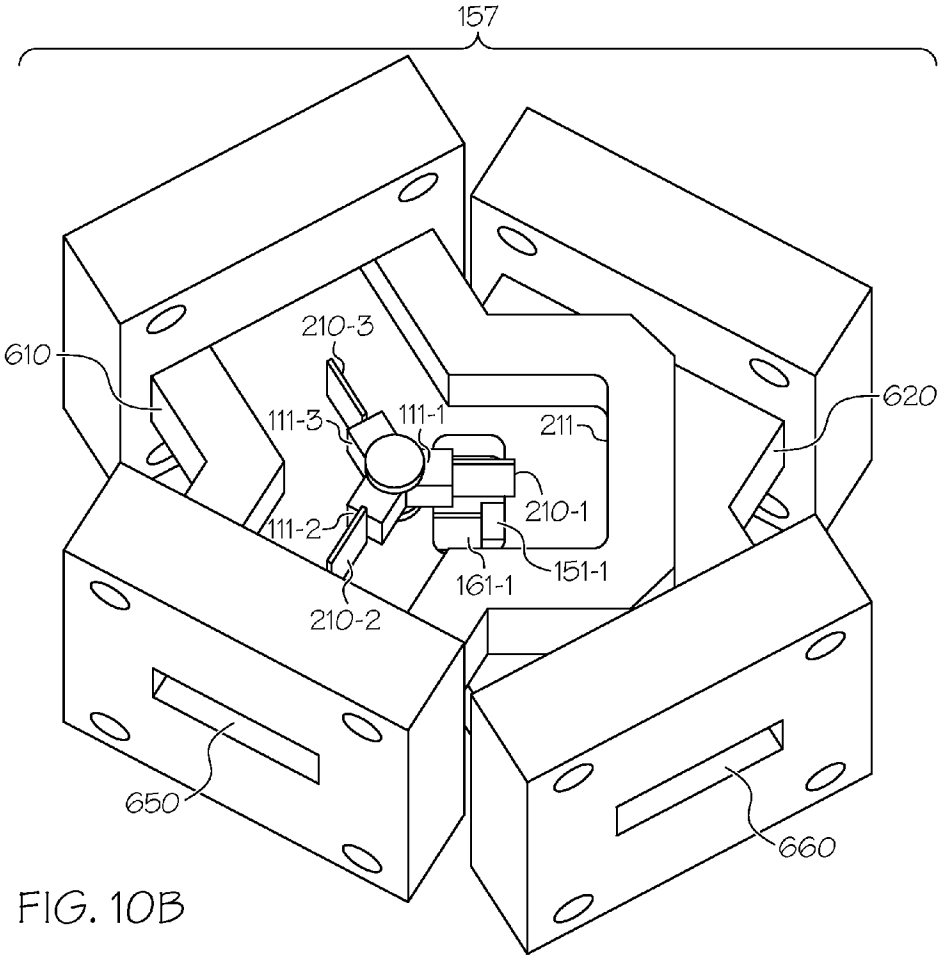
Figure 10C:
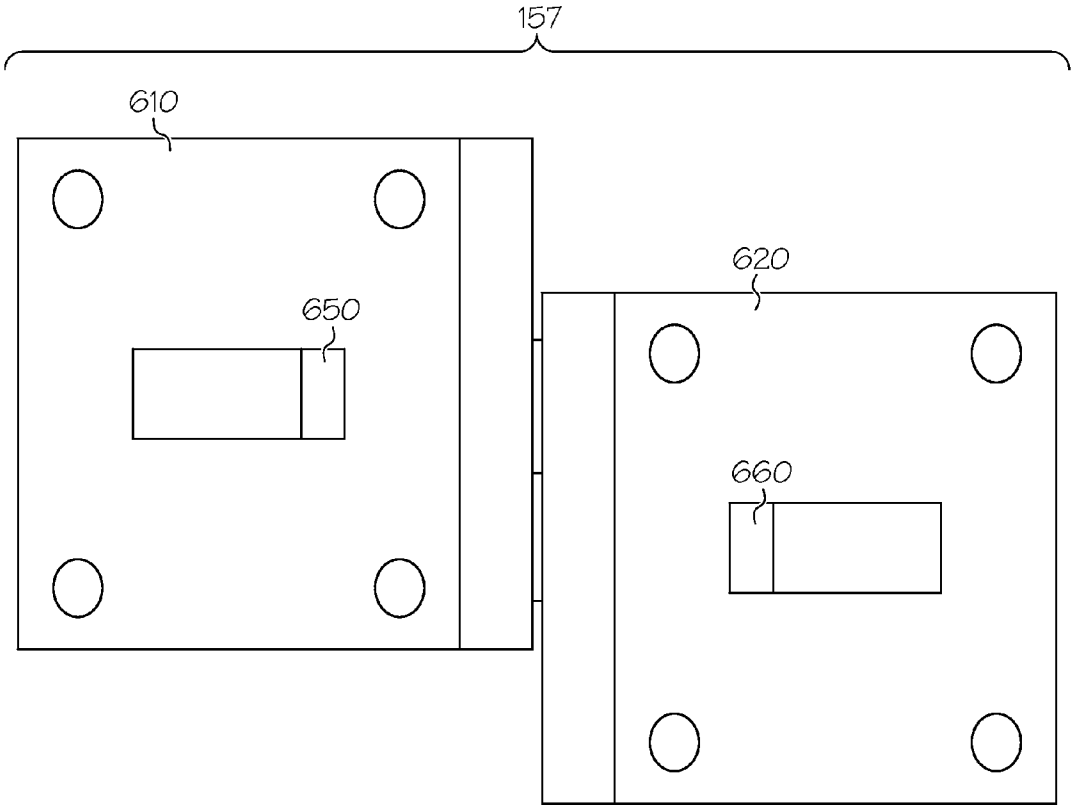

FIGS. 10A-10C are block diagrams illustrating top, oblique, and side views, respectively, of a waveguide circulator system 157 in a housing 610 and a housing 620 in accordance with one embodiment. Specifically, the housing 610 encases the first-ferrite element 109-1 and the quarter-wave dielectric transformers 210(1-3) that are attached to respective ends of the three segments 111(1-3) of the first-ferrite element 109-1. The housing 610 has ports including port 650 (FIGS. 10B and 10C). Likewise, the housing 620 encases the second-ferrite element 109-2 and the quarter-wave dielectric transformers 161(1-3) that are attached to respective ends of the three segments 151(1-3) of the second-ferrite element 109-2. The housing 610 has ports including port 660 (FIGS. 10B and 10C). The housings 610 and 620 are configured such that, when attached to each other, the E-plane-transition waveguide 320 is formed within an interfacing region formed by the structure of the housings 610 and 620.

The housings 610 and 620 encase components in the waveguide circulator system 157 so that at least a portion of the first quarter-wave dielectric transformer 210-1 and at least a portion of the first segment 111-1 of the ferrite element 109-1 protrude into the first transition region (as described above) while at least a portion of the second quarter-wave dielectric transformer 161-1 and at least a portion of the first segment 151-1 of the second-ferrite element 109-2 protrude into the second transition region (as described above).

As is understood by one skilled in the art, a plurality of waveguide circulator systems can be interfaced to each other to form an order-constrained switch network. For example, with reference to FIGS. 6A-6C, an order-constrained switch network is formed when the output end of waveguide arm 460-2 of a first waveguide circulator system 153 is attached to in the input end of waveguide arm 405-3 of a second waveguide circulator system 153 and the output end of waveguide arm 460-3 of the first waveguide circulator system 153 is attached to in the input end of waveguide arm 405-2 of a third waveguide circulator system 153. Each of the output ends of waveguide arms 460-2 and 460-3 of the second and third waveguide circulator systems 153 are attached to four additional waveguide circulator systems 153. In some embodiments the second and third waveguide circulator systems 153 are rotated so that the Z axis is pointing in the negative z direction. In this case the height (in the z-axis direction) of the order-constrained switch network is held to the height of a single waveguide circulator system 153. A plurality of pairs of housings 610 and 620 (FIGS. 10A-10C) can be bolted to each other form an order-constrained switch network. Combinations of waveguide circulator systems 153, 154, 154, or 156 can be attached at the two output ports to any desired combination of waveguide circulator systems 153, 154, 154, or 156, as is understandable to one skilled in the art, to form various order-constrained switch networks.

Figure 11:
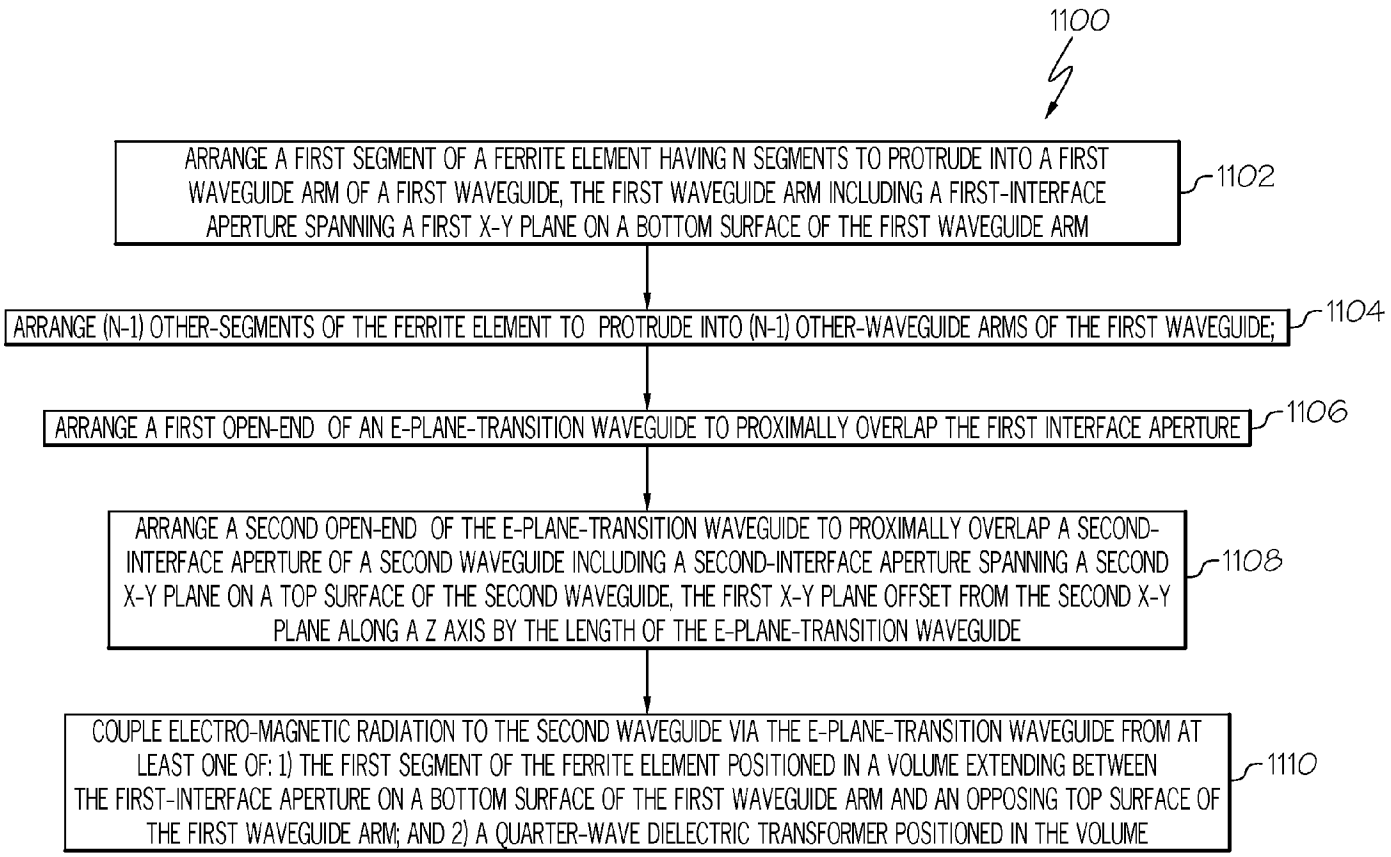
FIG. 11 is a flow diagram illustrating a method for circulating electro-magnetic radiation in a waveguide circulator system according to embodiments.

FIG. 11 is a flow diagram illustrating a method 1100 for circulating electro-magnetic radiation in a waveguide circulator system according to embodiments. The method 1100 is described with reference to the waveguide circulator systems 150, 151, 152, 153, 154, 155, 156 and 157 described above with reference to FIGS. 2A-2C, 3A-3C, 4A-4C, 6A-6C, 7A-7C, 8A-8C, 9A-9C and 10A-10C, although it is to be understood that method 1100 can be implemented using other embodiments of the waveguide circulator system as is understandable by one skilled in the art who reads this document.

At block 1102, a first segment 111-1 of a ferrite element 109 having N segments is arranged to protrude into a first waveguide arm 105-1 of a first waveguide 110. The first waveguide arm 105-1 includes a first-interface aperture 205 spanning a first X-Y plane on a bottom surface 148 of the first waveguide arm 105-1. As shown in the embodiments of FIGS. 2A-2C, 3A-3C, 4A-4C, the first waveguide is the first waveguide 110. As shown in the embodiments of FIGS. 6A-6C, 7A-7C, 8A-8C, and 9A-9C, the first waveguide is the first waveguide 310. At block 1104, (N−1) other-segments of the ferrite element 109 to protrude into (N−1) other-waveguide arms of the first waveguide 110. In embodiments, a portion of the first segment 111-1 is arranged to protrude into a first volume (also referred to herein as a first transition region).

At block 1106, a first open-end 206 of an E-plane-transition waveguide 120 is arranged to proximally overlap the first-interface aperture 205. This overlapping section is a port (input or output depending of the direction of propagation of electro-magnetic fields) of an E-field T-junction. In some embodiments, a quarter-wave dielectric transformer is attached to the first segment 111-1 of the ferrite element 109. In this latter embodiment, the quarter-wave dielectric transformer is arranged to extend into the first-waveguide arm of the first waveguide 110 to protrude into a first volume (also referred to herein as a first transition region).

At block 1108, a second open-end 207 of the E-plane-transition waveguide 120 is arranged to proximally overlap a second-interface aperture 208 of a second waveguide 130. This overlapping section is a port (input or output depending of the direction of propagation of electro-magnetic fields) of an E-field T-junction. The first X-Y plane offset from the second X-Y plane along a Z axis by the length of the E-plane-transition waveguide 120.

At block 1110, the electro-magnetic radiation is coupled to the second waveguide 130 via the E-plane-transition waveguide 120 from at least one of: 1) the first segment 111-1 of the ferrite element 109 positioned in a volume extending between the first-interface aperture 205 on a bottom surface 148 of the first waveguide arm 105-1 and an opposing top surface 149 of the first waveguide arm 105-1; and 2) a quarter-wave dielectric transformer positioned in the volume.

In some embodiments, a second segment 151-1 of a second-ferrite element 109-2 having M segments 151(1-M) is arranged to protrude into a second waveguide arm 460-1 of the second waveguide 130 and (M−1) other-segments of the second-ferrite element 109-2 are arranged to protrude into (M−1) other-waveguide arms of the second waveguide 130. Is some implementation of this latter embodiment, a second quarter-wave dielectric transformer 161-1 is attached to the second segment 151-1 of the second-ferrite element 109-2.

EXAMPLE EMBODIMENTS

Example 1 includes a waveguide circulator system for an E-plane-layer transition of an electro-magnetic field having a wavelength, the waveguide circulator comprising: a first waveguide including: at least N waveguide arms, where N is a positive integer, and a first-interface aperture spanning a first X-Y plane on a bottom surface of a first waveguide arm of the first waveguide, a ferrite element having N segments protruding into the N respective waveguide arms of the first waveguide, the N segments including a first segment protrude into a first waveguide arm of the first waveguide; an E-plane-transition waveguide having a first open-end and a second opposing open-end defined by side-walls having a length; and a second waveguide including a second-interface aperture spanning a second X-Y plane on a top surface of the second waveguide, the first X-Y plane offset from the second X-Y plane along a Z axis by the length of the E-plane-transition waveguide, wherein the first open-end of the E-plane-transition waveguide is approximately a same shape as the first-interface aperture of the first waveguide and the first-interface aperture is arranged to proximally overlap the first open-end, wherein the second open-end of the E-plane-transition waveguide is approximately a same shape as the second second-interface aperture of the second waveguide and the second-interface aperture is arranged to proximally overlap the second open-end, and wherein at least a portion of the first segment of the ferrite element protrudes into a volume extending between the first-interface aperture on the bottom surface of the first waveguide arm and an opposing top surface of the first waveguide arm.

Example 2 includes the waveguide circulator system of Example 1, further comprising a backshort spanning a Y-Z plane at an end of the first waveguide arm, the backshort being position about a quarter of the wavelength from the first-interface aperture.

Example 3 includes the waveguide circulator system of any of Examples 1-2, wherein the length of the side-walls of the E-plane-transition waveguide is less than a quarter of the wavelength.

Example 4 includes the waveguide circulator system of any of Examples 1-3, further comprising: N quarter-wave dielectric transformers attached to respective ends of the N segments of the ferrite element, the N quarter-wave dielectric transformers including a first quarter-wave dielectric transformer attached to the first segment of the ferrite element, wherein at least a portion of the first quarter-wave dielectric transformer protrudes into the volume.

Example 5 includes the waveguide circulator system of Example 4, wherein the ferrite element having N segments is a first-ferrite element, wherein the volume is a first volume, and wherein the second waveguide includes at least M waveguide arms, where M is a positive integer, wherein the second-interface aperture spans the second X-Y plane on the top surface of a second waveguide arm; the waveguide circulator system further including a second-ferrite element having M segments protruding into the M respective waveguide arms of the second waveguide, wherein a second segment of the second-ferrite element protrudes into the second waveguide arm, wherein at least a portion of the second segment of the second-ferrite element protrudes into a second volume extending between the second-interface aperture on the top surface of the second waveguide arm and an opposing bottom surface of the second waveguide arm.

Example 6 includes the waveguide circulator system of any of Examples 1-5, further comprising: M quarter-wave dielectric transformers attached to respective ends of the M segments of the second-ferrite element, the M quarter-wave dielectric transformers including a second quarter-wave dielectric transformer attached to a second segment of the second-ferrite element, wherein the second quarter-wave dielectric transformer and the second segment protrude into a second waveguide arm of the second waveguide, wherein at least a portion of the second quarter-wave dielectric transformer protrudes into the second volume.

Example 7 includes the waveguide circulator system of Example 6, wherein at least a portion of the second quarter-wave dielectric transformer protrudes into the second volume.

Example 8 includes the waveguide circulator system of any of Examples 1-7, wherein the ferrite element having N segments is a first-ferrite element, wherein the volume is a first volume, and wherein the second waveguide includes at least M waveguide arms, where M is a positive integer, wherein the second-interface aperture spans the second X-Y plane on the top surface of a second waveguide arm, the waveguide circulator system further including: a second-ferrite element having M segments protruding into the M respective waveguide arms of the second waveguide, wherein a second segment of the second-ferrite element protrudes into the second waveguide arm, wherein at least a portion of the second segment of the second-ferrite element protrudes into a second volume extending between the second-interface aperture on the top surface of the second waveguide arm and an opposing bottom surface of the second waveguide arm.

Example 9 includes the waveguide circulator system of any of Examples 1-8, further comprising: quarter-wave dielectric transformers attached to respective ends of the M segments of the second-ferrite element, the M quarter-wave dielectric transformers including a first quarter-wave dielectric transformer attached to the second segment of the second-ferrite element, wherein at least a portion of the second quarter-wave dielectric transformer protrudes into the second volume extending.

Example 10 includes a method for circulating electro-magnetic radiation in a waveguide circulator system to transition an electro-magnetic field, having a wavelength, in E-plane-layer transition, the method comprising: arranging a first segment of a ferrite element having N segments, where N is a positive integer, to protrude into a first waveguide arm of a first waveguide, the first waveguide arm including a first-interface aperture spanning a first X-Y plane on a bottom surface of the first waveguide arm; arranging (N−1) other-segments of the ferrite element to protrude into (N−1) other-waveguide arms of the first waveguide; arranging a first open-end of an E-plane-transition waveguide to proximally overlap the first-interface aperture; arranging a second open-end of the E-plane-transition waveguide to proximally overlap a second-interface aperture of a second waveguide including the second-interface aperture spanning a second X-Y plane on a top surface of the second waveguide, the first X-Y plane offset from the second X-Y plane along a Z axis by a length of the E-plane-transition waveguide; and coupling electro-magnetic radiation to the second waveguide via the E-plane-transition waveguide from at least one of: 1) the first segment of the ferrite element positioned in a volume extending between the first-interface aperture on the bottom surface of the first waveguide arm and an opposing top surface of the first waveguide arm; and 2) a quarter-wave dielectric transformer positioned in the volume.

Example 11 includes the method of Example 10, further comprising: attaching the quarter-wave dielectric transformer to the first segment of the ferrite element; and arranging the quarter-wave dielectric transformer to extend into the first-waveguide arm of the first waveguide to protrude into the volume.

Example 12 includes the method of Example 11, wherein the ferrite element is a first-ferrite element, the volume is a first volume, and the quarter-wave dielectric transformer is a first quarter-wave dielectric transformer, the method further comprising; arranging a second segment of a second-ferrite element having M segments, where M is a positive integer, to protrude into a second waveguide arm of the second waveguide, the second waveguide arm including the second-interface aperture of the second waveguide; and arranging (M−1) other-segments of the second-ferrite element to protrude into (M−1) other-waveguide arms of the second waveguide, wherein coupling electro-magnetic radiation to the second waveguide via the E-plane-transition waveguide comprises: coupling electro-magnetic radiation to the second waveguide arm of the second waveguide via the E-plane-transition waveguide to at least one of: 1) the second segment of the second ferrite element positioned in a second volume extending between the second-interface aperture on the top surface of the second waveguide arm and an opposing bottom surface of the second waveguide arm; and 2) a second quarter-wave dielectric transformer positioned in the second volume.

Example 13 includes the method of Example 12, further comprising: attaching the second quarter-wave dielectric transformer to the second segment of the second ferrite element; and arranging the second quarter-wave dielectric transformer to extend into the second waveguide arm of the second waveguide to protrude into the second volume.

Example 14 includes the method of any of Examples 10-11, wherein the ferrite element is a first-ferrite element, the volume is a first volume, the method further comprising; arranging a second segment of a second-ferrite element having M segments, where M is a positive integer, to protrude into a second waveguide arm of the second waveguide, the second waveguide arm including the second-interface aperture of the second waveguide; and arranging (M-1) other-segments of the second-ferrite element to protrude into (M−1) other-waveguide arms of the second waveguide, wherein coupling electro-magnetic radiation to the second waveguide via the E-plane-transition waveguide comprises: coupling electro-magnetic radiation to the second waveguide arm of the second waveguide via the E-plane-transition waveguide to the second segment of the second ferrite element positioned in a second volume extending between the second-interface aperture on the top surface of the second waveguide arm and an opposing bottom surface of the second waveguide arm.

Example 15 includes a waveguide circulator system for an E-plane-layer transition of an electro-magnetic field having a wavelength, the waveguide circulator comprising: a first waveguide including: at least N waveguide arms, where N is a positive integer, a first-interface aperture spanning a first X-Y plane on a bottom surface of the first waveguide arm of the first waveguide, a ferrite element having N segments protruding into the N respective waveguide arms of the first waveguide; N quarter-wave dielectric transformers attached to respective ends of the N segments of the ferrite element, the N quarter-wave dielectric transformers including a first quarter-wave dielectric transformer attached to a first segment of the ferrite element, wherein the first quarter-wave dielectric transformer and the first segment protrude into the first waveguide arm of the first waveguide; an E-plane-transition waveguide having a first open-end and a second opposing open-end defined by side-walls; and a second waveguide including a second-interface aperture spanning a second X-Y plane on a top surface of the second waveguide, the first X-Y plane offset from the second X-Y plane along a Z axis by a length of the E-plane-transition waveguide, wherein the first open-end of the E-plane-transition waveguide is approximately a same shape as the first-interface aperture of the first waveguide and the first-interface aperture is arranged to proximally overlap the first open-end, wherein the second open-end of the E-plane-transition waveguide is approximately a same shape as the second second-interface aperture of the second waveguide and the second-interface aperture is arranged to proximally overlap the second open-end, and wherein at least a portion of the first quarter-wave dielectric transformer protrudes into a volume extending between the first-interface aperture on the bottom surface of the first waveguide arm and an opposing top surface of the first waveguide arm.

Example 16 includes the waveguide circulator system of Example 15, wherein at least a portion of the first segment of the ferrite element protrudes into the volume.

Example 17 includes the waveguide circulator system of any of Examples 15-16, wherein the at least one ferrite element having N segments is a first-ferrite element, wherein the volume is a first volume, and wherein the second waveguide includes at least M waveguide arms, where M is a positive integer; the waveguide circulator system further including at least one second-ferrite element having M segments protruding into the M respective waveguide arms of the second waveguide; and M quarter-wave dielectric transformers attached to respective ends of the M segments of the second-ferrite element, the M quarter-wave dielectric transformers including a second quarter-wave dielectric transformer attached to a second segment of the second-ferrite element, wherein the second quarter-wave dielectric transformer and the second segment protrude into a second waveguide arm of the second waveguide, wherein at least a portion of the second quarter-wave dielectric transformer protrudes into a second volume extending between the second-interface aperture on the top surface of the second waveguide arm and an opposing bottom surface of the second waveguide arm.

Example 18 includes the waveguide circulator system of Example 17, wherein at least a portion of the first segment of the first-ferrite element protrudes into the first volume.

Example 19 includes the waveguide circulator system of Example 17, wherein at least a portion of the first segment of the first-ferrite element protrudes into the first volume, and at least a portion of the first segment of the second-ferrite element protrudes into the second volume.

Example 20 includes the waveguide circulator system of any of Examples 15-19, further comprising a backshort spanning a Y-Z plane at an end of the first waveguide arm, the backshort being position about a quarter of the wavelength from the first-interface aperture Although specific embodiments have been illustrated and described herein, it will be appreciated by those of ordinary skill in the art that any arrangement, which is calculated to achieve the same purpose, may be substituted for the specific embodiment shown. This application is intended to cover any adaptations or variations of the present invention. Therefore, it is manifestly intended that this invention be limited only by the claims and the equivalents thereof.

What is claimed is:

1. A waveguide circulator system for an E-plane-layer transition of an electro-magnetic field having a wavelength, the waveguide circulator comprising:

a first waveguide including:

at least N waveguide arms, where N is a positive integer, and a first-interface aperture spanning a first X-Y plane on a bottom surface of a first waveguide arm of the first waveguide;

a ferrite element having N segments protruding into the N respective waveguide arms of the first waveguide, the N segments including a first segment protrude into a first waveguide arm of the first waveguide;

an E-plane-transition waveguide having a first open-end and a second opposing open-end defined by side-walls having a length; and a second waveguide including a second-interface aperture spanning a second X-Y plane on a top surface of the second waveguide, the first X-Y plane offset from the second X-Y plane along a Z axis by the length of the E-plane-transition waveguide, wherein the first open-end of the E-plane-transition waveguide is approximately a same shape as the first-interface aperture of the first waveguide and the first-interface aperture is arranged to proximally overlap the first open-end, wherein the second open-end of the E-plane-transition waveguide is approximately a same shape as the second second-interface aperture of the second waveguide and the second-interface aperture is arranged to proximally overlap the second open-end, and wherein at least a portion of the first segment of the ferrite element protrudes into a volume extending between the first-interface aperture on the bottom surface of the first waveguide arm and an opposing top surface of the first waveguide arm.

2. The waveguide circulator system of claim 1, further comprising a backshort spanning a Y-Z plane at an end of the first waveguide arm, the backshort being positioned about a quarter of the wavelength ($\lambda/4$) from the first-interface aperture.

3. The waveguide circulator system of claim 1, wherein the length of the side-walls of the E-plane-transition waveguide is less than a quarter of the wavelength ($\lambda/4$).

4. The waveguide circulator system of claim 1, wherein the ferrite element having N segments is a first-ferrite element, wherein the volume is a first volume, and wherein the second waveguide includes at least M waveguide arms, where M is a positive integer, wherein the second-interface aperture spans the second X-Y plane on the top surface of a second waveguide arm, the waveguide circulator system further including:

a second-ferrite element having M segments protruding into the M respective waveguide arms of the second waveguide, wherein a second segment of the second-ferrite element protrudes into the second waveguide arm, wherein at least a portion of the second segment of the second-ferrite element protrudes into a second volume extending between the second-interface aperture on the top surface of the second waveguide arm and an opposing bottom surface of the second waveguide arm.

5. The waveguide circulator system of claim 1, further comprising:

quarter-wave dielectric transformers attached to respective ends of the M segments of the second-ferrite element, the M quarter-wave dielectric transformers including a first quarter-wave dielectric transformer attached to the second segment of the second-ferrite element, wherein at least a portion of the second quarter-wave dielectric transformer protrudes into the second volume extending.

6. The waveguide circulator system of claim 1, further comprising:

N quarter-wave dielectric transformers attached to respective ends of the N segments of the ferrite element, the N quarter-wave dielectric transformers including a first quarter-wave dielectric transformer attached to the first segment of the ferrite element, wherein at least a portion of the first quarter-wave dielectric transformer protrudes into the volume.

7. The waveguide circulator system of claim 6, wherein the ferrite element having N segments is a first-ferrite element, wherein the volume is a first volume, and wherein the second waveguide includes at least M waveguide arms, where M is a positive integer, wherein the second-interface aperture spans the second X-Y plane on the top surface of a second waveguide arm;

the waveguide circulator system further including a second-ferrite element having M segments protruding into the M respective waveguide arms of the second waveguide, wherein a second segment of the second-ferrite element protrudes into the second waveguide arm, wherein at least a portion of the second segment of the second-ferrite element protrudes into a second volume extending between the second-interface aperture on the top surface of the second waveguide arm and an opposing bottom surface of the second waveguide arm.

8. The waveguide circulator system of claim 7, further comprising:

M quarter-wave dielectric transformers attached to respective ends of the M segments of the second-ferrite element, the M quarter-wave dielectric transformers including a second quarter-wave dielectric transformer attached to a second segment of the second-ferrite element, wherein the second quarter-wave dielectric transformer and the second segment protrude into a second waveguide arm of the second waveguide, wherein at least a portion of the second quarter-wave dielectric transformer protrudes into the second volume.

9. The waveguide circulator system of claim 8, wherein at least a portion of the second quarter-wave dielectric transformer protrudes into the second volume.

10. A waveguide circulator system for an E-plane-layer transition of an electro-magnetic field having a wavelength, the waveguide circulator comprising:

a first waveguide including:

at least N waveguide arms, where N is a positive integer, a first-interface aperture spanning a first X-Y plane on a bottom surface of the first waveguide arm of the first waveguide, a ferrite element having N segments protruding into the N respective waveguide arms of the first waveguide;

N quarter-wave dielectric transformers attached to respective ends of the N segments of the ferrite element, the N quarter-wave dielectric transformers including a first quarter-wave dielectric transformer attached to a first segment of the ferrite element, wherein the first quarter-wave dielectric transformer and the first segment protrude into the first waveguide arm of the first waveguide;

an E-plane-transition waveguide having a first open-end and a second opposing open-end defined by side-walls; and a second waveguide including a second-interface aperture spanning a second X-Y plane on a top surface of the second waveguide, the first X-Y plane offset from the second X-Y plane along a Z axis by a length of the E-plane-transition waveguide, wherein the first open-end of the E-plane-transition waveguide is approximately a same shape as the first-interface aperture of the first waveguide and the first-interface aperture is arranged to proximally overlap the first open-end, wherein the second open-end of the E-plane-transition waveguide is approximately a same shape as the second second-interface aperture of the second waveguide and the second-interface aperture is arranged to proximally overlap the second open-end, and wherein at least a portion of the first quarter-wave dielectric transformer protrudes into a volume extending between the first-interface aperture on the bottom surface of the first waveguide arm and an opposing top surface of the first waveguide arm.

11. The waveguide circulator system of claim 10, wherein at least a portion of the first segment of the ferrite element protrudes into the volume.

12. The waveguide circulator system of claim 10, further comprising a backshort spanning a Y-Z plane at an end of the first waveguide arm, the backshort being position about a quarter of the wavelength ($\lambda/4$) from the first-interface aperture.

13. The waveguide circulator system of claim 10, wherein the at least one ferrite element having N segments is a first-ferrite element, wherein the volume is a first volume, and wherein the second waveguide includes at least M waveguide arms, where M is a positive integer;

the waveguide circulator system further including at least one second-ferrite element having M segments protruding into the M respective waveguide arms of the second waveguide; and M quarter-wave dielectric transformers attached to respective ends of the M segments of the second-ferrite element, the M quarter-wave dielectric transformers including a second quarter-wave dielectric transformer attached to a second segment of the second-ferrite element, wherein the second quarter-wave dielectric transformer and the second segment protrude into a second waveguide arm of the second waveguide, wherein at least a portion of the second quarter-wave dielectric transformer protrudes into a second volume extending between the second-interface aperture on the top surface of the second waveguide arm and an opposing bottom surface of the second waveguide arm.

14. The waveguide circulator system of claim 13, wherein at least a portion of the first segment of the first-ferrite element protrudes into the first volume.

15. The waveguide circulator system of claim 13, wherein at least a portion of the first segment of the first-ferrite element protrudes into the first volume, and at least a portion of the first segment of the second-ferrite element protrudes into the second volume.

16. A method for circulating electro-magnetic radiation in a waveguide circulator system to transition an electro-magnetic field, having a wavelength, in E-plane-layer transition, the method comprising:

arranging a first segment of a ferrite element having N segments, where N is a positive integer, to protrude into a first waveguide arm of a first waveguide, the first waveguide arm including a first-interface aperture spanning a first X-Y plane on a bottom surface of the first waveguide arm;

arranging (N−1) other-segments of the ferrite element to protrude into (N−1) other-waveguide arms of the first waveguide;

arranging a first open-end of an E-plane-transition waveguide to proximally overlap the first-interface aperture;

arranging a second open-end of the E-plane-transition waveguide to proximally overlap a second-interface aperture of a second waveguide including the second-interface aperture spanning a second X-Y plane on a top surface of the second waveguide, the first X-Y plane offset from the second X-Y plane along a Z axis by a length of the E-plane-transition waveguide; and coupling electro-magnetic radiation to the second waveguide via the E-plane-transition waveguide from at least one of: 1) the first segment of the ferrite element positioned in a volume extending between the first-interface aperture on the bottom surface of the first waveguide arm and an opposing top surface of the first waveguide arm; and 2) a quarter-wave dielectric transformer positioned in the volume.

17. The method of claim 16, wherein the ferrite element is a first-ferrite element, the volume is a first volume, the method further comprising;

arranging a second segment of a second-ferrite element having M segments, where M is a positive integer, to protrude into a second waveguide arm of the second waveguide, the second waveguide arm including the second-interface aperture of the second waveguide; and arranging (M−1) other-segments of the second-ferrite element to protrude into (M−1) other-waveguide arms of the second waveguide, wherein coupling electro-magnetic radiation to the second waveguide via the E-plane-transition waveguide comprises:

coupling electro-magnetic radiation to the second waveguide arm of the second waveguide via the E-plane-transition waveguide to the second segment of the second ferrite element positioned in a second volume extending between the second-interface aperture on the top surface of the second waveguide arm and an opposing bottom surface of the second waveguide arm.

18. The method of claim 16, further comprising:

attaching the quarter-wave dielectric transformer to the first segment of the ferrite element; and arranging the quarter-wave dielectric transformer to extend into the first-waveguide arm of the first waveguide to protrude into the volume.

19. The method of claim 18, wherein the ferrite element is a first-ferrite element, the volume is a first volume, and the quarter-wave dielectric transformer is a first quarter-wave dielectric transformer, the method further comprising;

arranging a second segment of a second-ferrite element having M segments, where M is a positive integer, to protrude into a second waveguide arm of the second waveguide, the second waveguide arm including the second-interface aperture of the second waveguide; and arranging (M−1) other-segments of the second-ferrite element to protrude into (M−1) other-waveguide arms of the second waveguide, wherein coupling electro-magnetic radiation to the second waveguide via the E-plane-transition waveguide comprises:

coupling electro-magnetic radiation to the second waveguide arm of the second waveguide via the E-plane-transition waveguide to at least one of: 1) the second segment of the second ferrite element positioned in a second volume extending between the second-interface aperture on the top surface of the second waveguide arm and an opposing bottom surface of the second waveguide arm; and 2) a second quarter-wave dielectric transformer positioned in the second volume.

20. The method of claim 19, further comprising:

attaching the second quarter-wave dielectric transformer to the second segment of the second ferrite element; and arranging the second quarter-wave dielectric transformer to extend into the second waveguide arm of the second waveguide to protrude into the second volume.

* * * * *